US009322562B2

(12) United States Patent
Takayama et al.

(10) Patent No.: US 9,322,562 B2
(45) Date of Patent: Apr. 26, 2016

(54) AIR-CONDITIONING APPARATUS

(75) Inventors: Keisuke Takayama, Chiyoda-ku (JP); Koji Yamashita, Chiyoda-ku (JP); Hiroyuki Morimoto, Tokyo (JP); Yusuke Shimazu, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 258 days.

(21) Appl. No.: 13/256,982

(22) PCT Filed: Apr. 1, 2009

(86) PCT No.: PCT/JP2009/056793

§ 371 (c)(1),
(2), (4) Date: Sep. 16, 2011

(87) PCT Pub. No.: WO2010/113296

PCT Pub. Date: Oct. 7, 2010

(65) Prior Publication Data

US 2012/0006050 A1 Jan. 12, 2012

(51) Int. Cl.
*F25B 13/00* (2006.01)
*F25B 41/04* (2006.01)
(Continued)

(52) U.S. Cl.
CPC ..... *F24F 3/065* (2013.01); *F25B 13/00* (2013.01); *F25B 25/005* (2013.01); *F25B 2313/0231* (2013.01); *F25B 2313/0272* (2013.01); *F25B 2313/02741* (2013.01)

(58) Field of Classification Search
CPC .... F25B 13/00; F25B 2313/023; F25B 41/04; F25B 2313/0231; F25B 5/02; F25B 2313/007; F25B 2313/006; F24F 3/065; F24F 2221/54; F24F 11/0012; F24F 11/085; F24F 3/153; F24F 11/008
USPC ..... 62/79, 113, 238.7, 498, 513, 519, 524, 62/200, 159, 324.6, 160; 165/96, 201
See application file for complete search history.

(56) References Cited

U.S. PATENT DOCUMENTS 4,644,756 A * 2/1987 Sugimoto et al. ..... 62/160
5,159,817 A * 11/1992 Hojo ..... F24F 3/065 62/199

(Continued)

FOREIGN PATENT DOCUMENTS

CN 1540265 A 10/2004
EP 1437559 * 7/2004

(Continued)

OTHER PUBLICATIONS

English translation of JP 03017475.*

(Continued)

*Primary Examiner* — Mohammad M Ali
*Assistant Examiner* — Meraj A Shaikh
(74) *Attorney, Agent, or Firm* — Buchanan Ingersoll & Rooney PC

(57) ABSTRACT

Use side heat exchangers, an intermediate heat exchanger that heats a heat medium flowing to the use side heat exchangers, an intermediate heat exchanger that cools the heat medium flowing to the use side heat exchangers, three-way valves that switch between a flow path connecting the intermediate heat exchanger to the use side heat exchangers and a flow path connecting the intermediate heat exchanger to the use side heat exchangers, and three-way valves and bypasses that control the flow rate of the heat medium flowing into the use side heat exchangers are included. When at least one of the use side heat exchangers is switched from a stop state to an operation state or switched to another operation mode, the flow rate of the heat medium flowing into this use side heat exchanger is suppressed, and a change in air output temperature in the use side heat exchangers other than this use side heat exchanger is suppressed.

10 Claims, 9 Drawing Sheets

(51) Int. Cl.

| | |
|---|---|
| ***F25B 5/02*** | (2006.01) |
| ***F24F 3/153*** | (2006.01) |
| ***F24F 3/06*** | (2006.01) |
| ***F25B 25/00*** | (2006.01) |

(56) References Cited

U.S. PATENT DOCUMENTS

| | | | | |
|---|---|---|---|---|
| 5,237,833 | A * | 8/1993 | Hayashida | F24F 3/065 62/228.1 |
| 5,263,333 | A * | 11/1993 | Kubo et al. | 62/160 |
| 5,297,392 | A * | 3/1994 | Takata et al. | 62/160 |
| 6,044,652 | A * | 4/2000 | Nishihara et al. | 62/175 |
| 6,952,933 | B2 * | 10/2005 | Song et al. | 62/200 |
| 7,131,283 | B2 * | 11/2006 | Oh et al. | 62/159 |
| 9,212,825 | B2 * | 12/2015 | Wakamoto | F24F 3/06 |
| 2002/0124585 | A1 * | 9/2002 | Bash | F25B 5/02 62/228.4 |
| 2004/0093881 | A1 * | 5/2004 | Kim | 62/228.5 |
| 2005/0155361 | A1 * | 7/2005 | Jung et al. | 62/159 |
| 2006/0026979 | A1 * | 2/2006 | Jung et al. | 62/199 |
| 2006/0237552 | A1 * | 10/2006 | Umemura et al. | 236/92 B |
| 2006/0248906 | A1 * | 11/2006 | Burk et al. | 62/160 |
| 2007/0130978 | A1 * | 6/2007 | Honda | 62/238.7 |

FOREIGN PATENT DOCUMENTS

| | | | |
|---|---|---|---|
| JP | 03017475 | A * | 1/1991 |
| JP | 4-139358 | A | 5/1992 |
| JP | 4-214134 | A | 8/1992 |
| JP | 5-54921 | U | 7/1993 |
| JP | 10-253181 | A | 9/1998 |
| JP | 11-344240 | A | 12/1999 |
| JP | 2003-343936 | A | 12/2003 |
| JP | 2004-53069 | A | 2/2004 |
| JP | 2004-053089 | A | 2/2004 |

OTHER PUBLICATIONS

Notification of the First Office Action issued on Aug. 5, 2013, by the Chinese Patent Office in corresponding Chinese Patent Application No. 200980158501.X and an English Translation of the Office Action (9 pages).

Office Action (Notice of Reasons for Rejection) issued by the Japanese Patent Office on Jun. 18, 2013, in the corresponding Japanese Patent Application No. 2011-506913, and an English Translation thereof. (5 pages).

Japanese Office Action (Notification of Reason for Refusal) dated Nov. 6, 2012, issued in corresponding Japanese Patent Application No. 2011-506913, and English language translation of Office Action. (5 pages).

International Search Report (PCT/ISA/210) issued on Jul. 7, 2009, by Japanese Patent Office as the International Searching Authority for International Application No. PCT/JP2009/056793.

* cited by examiner

AIR-CONDITIONING APPARATUS

TECHNICAL FIELD

The present invention relates to an air-conditioning apparatus such as a multi-unit air conditioner for buildings.

BACKGROUND ART

In some of related-art air-conditioning apparatuses including a plurality of indoor units (use side heat exchangers) and used as a multi-unit air conditioner for buildings or the like, a safe heat medium, such as water, is heated or cooled by an intermediate heat exchanger in a heat source unit and the heat medium is circulated in the use side heat exchangers. In such air-conditioning apparatuses, as a type in which each indoor unit is capable of individually performing a cooling operation and a heating operation, for example, there is proposed "an air-conditioning apparatus in which two absorption cold hot water units 1a and 1b and a cooling tower 2 for chilled water cooling in the cooling operation are installed on a roof of a building. These cold hot water units 1a and 1b are respectively connected to cold hot water pipes 3a and 3b, and the cold hot water pipes respectively include cold hot water pumps 4a and 4b for supplying cold or hot water to floors. The cold hot water pipes 3a and 3b communicate with air conditioning indoor units 5 (for the first floor), 6 (for the second floor), 7 (for the third floor), and 8 (for the forth floor) in the floors of the building, and the indoor units 5, 6, 7, and 8 each include an air conditioning controller 9, a blowing fan 10, and a cold hot air switching valve 11" (refer to Patent Document 1, for example).

As a type in which each indoor unit (use side heat exchanger) is not capable of individually performing the cooling operation and the heating operation, for example, there is proposed "an air-conditioning apparatus in which cold or hot water is produced by an air cooling heat pump cycle having a period established by components 2 to 7, the water is circulated between a supply header 10 and a return header 9 by a cold hot water circulating pump 8, and the cold or hot water is circulated in each of fan coils 14 connected through the water pipes 15 and 16 to the supply header 10 and the return header 9 to perform a cooling or heating operation" (refer to Patent Document 2, for example).

Patent Document 1: Japanese Unexamined Patent Application Publication No. 4-214134 (Paragraph 0008, FIG. 1)

Patent Document 2: Japanese Unexamined Patent Application Publication No. 11-344240 (Abstract, FIG. 1)

DISCLOSURE OF INVENTION

Problems to be Solved by the Invention

However, in the related-art air-conditioning apparatus disclosed in Patent Document 1, since each indoor unit (use side heat exchanger) individually performs the cooling operation or the heating operation, the pipe through which hot water (high-temperature heat medium) flows and the pipe through which cold water (low-temperature heat medium) flows have to be separately connected to each use side heat exchanger. In other words, the use side heat exchanger has to be connected to a branch unit through two heat medium flow paths. Accordingly, connection of heat medium pipes is complicated, which is disadvantage.

Further, in the related-art air-conditioning apparatuses disclosed in Patent Document 1 and Patent Document 2, for example, in winter, the low-temperature heat medium stays in a use side heat exchanger which is in a stop state and the heat medium pipes connected thereto. When starting the operation of this use side heat exchanger, if the above-described low-temperature heat medium flows into another use side heat exchanger which is in the heating operation, heated air output temperature may be lowered. Further, for example, in summer, the high temperature heat medium stays in a use side heat exchanger which is in the stop state and the heat medium pipes connected thereto. When starting the operation of this use side heat exchanger, if the above-described high-temperature heat medium flows into another use side heat exchanger which is in the cooling operation, cooled air output temperature may be increased.

Moreover, in the air-conditioning apparatus disclosed in Patent Document 2 in which the branch unit is connected to each use side heat exchanger through one heat medium flow path, when the cooling and heating operations of the use side heat exchangers are simultaneously performed, there may be the following problems. For example, it is assumed that a certain use side heat exchanger switches an operation mode from the cooling operation to the heating operation. At this time, a low-temperature heat medium, staying in this use side heat exchanger and the heat medium pipe connecting the use side heat exchanger to the branch unit, flows into another use side heat exchanger which is in the heating operation. This results in a reduction in air output temperature of the other use side heat exchanger in the heating operation. In addition, for instance, it is assumed that a certain use side heat exchanger switches the operation mode from the heating operation to the cooling operation. At this time, a high-temperature heat medium, staying in this use side heat exchanger and the heat medium pipe connecting the use side heat exchanger to the branch unit, flows into another use side heat exchanger which is in the cooling operation. This results in an increase in air output temperature of the other use side heat exchanger in the cooling operation.

The present invention has been made in order to solve the above-described problems. It is an object of the present invention to provide an air-conditioning apparatus in which each use side heat exchanger can be connected to a branch unit through a single heat medium path and a heat medium heated or cooled by a heat source unit is circulated to each indoor unit (use side heat exchanger), the air-conditioning apparatus being capable of, when starting an operation of an indoor unit in the stop state, or when changing an operation mode of the indoor unit in an operation, simultaneously performing a cooling operation and a heating operation while suppressing a change in air output temperature of another use side heat exchanger.

Means for Solving the Problems

An air-conditioning apparatus according to the present invention includes a plurality of use side heat exchangers, a first heat exchanger that heats a heat medium flowing to the use side heat exchangers, a second heat exchanger that cools the heat medium flowing to the use side heat exchangers, a heat medium flow path switching device that switches between a flow path connecting the first heat exchanger to the use side heat exchangers and a flow path connecting the second heat exchanger to the use side heat exchangers, and a heat medium flow rate adjusting unit that controls the flow rate of the heat medium flowing into the use side heat exchangers, wherein when part of the use side heat exchangers is switched from a stop state to an operation state, or switched to another operation mode, the flow rate of the heat medium flowing into the switched use side heat exchanger is suppressed, a change in temperature of at least one of the heat medium flowing into the first heat exchanger and the heat medium flowing into the second heat exchanger is suppressed, and a change in air output temperature of the use side heat exchangers other than that switched use side heat exchanger is suppressed.

Advantageous

According to the present invention, when a use side heat exchanger in a stop state starts an operation, or when the use side heat exchanger is switched to another operation mode, the flow rate of the heat medium flowing into the use side heat exchanger is adjusted. Accordingly, the air-conditioning apparatus capable of simultaneously performing cooling and heating operations while suppressing a change in air output temperature of each of the other use side heat exchangers can be obtained.

Figure 1:
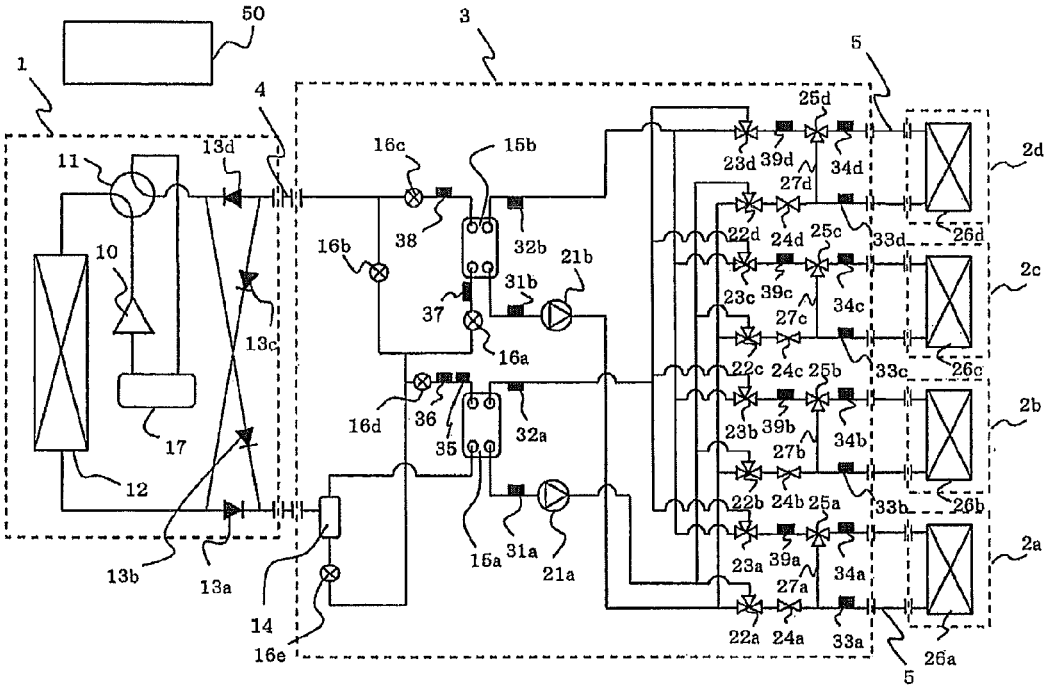
FIG. 1 is a system circuit diagram of an air-conditioning apparatus according to Embodiment 1 of the present invention.

REFERENCE NUMERALS heat source unit; 2*a*, 2*b*, 2*c*, 2*d* indoor unit; 3 relay unit; 4 refrigerant pipe; 5 heat medium pipe; 10 compressor; 11 four-way valve; 12 heat source side heat exchanger; 13*a*, 13*b*, 13*c*, 13*d* check valve; 14 gas-liquid separator; 15*a*, 15*b* intermediate heat exchanger; 16*a*, 16*b*, 16*c*, 16*d*, 16*e* expansion valve; 17 accumulator; 21*a*, 21*b* pump; 22*a*, 22*b*, 22*c*, 22*d* three-way valve; 23*a*, 23*b*, 23*c*, 23*d* three-way valve; 24*a*, 24*b*, 24*c*, 24*d* stop valve; 25*a*, 25*b*, 25*c*, 25*d* three-way valve; 26*a*, 26*b*, 26*c*, 26*d* use side heat exchanger; 27*a*, 27*b*, 27*c*, 27*d* bypass; 31*a*, 31*b* temperature sensor; 32*a*, 32*b* temperature sensor; 33*a*, 33*b*, 33*c*, 33*d* temperature sensor; 34*a*, 34*b*, 34*c*, 34*d* temperature sensor; 35 temperature sensor; 36 pressure sensor; 37 temperature sensor; temperature sensor; 39*a*, 39*b*, 39*c*, 39*d* temperature sensor; and 50 controller.

BEST MODES FOR CARRYING OUT THE INVENTION

Embodiment 1

FIG. 1 is a system circuit diagram of an air-conditioning apparatus according to Embodiment 1 of the present invention. The air-conditioning apparatus according to Embodiment 1 includes a compressor 10, a four-way valve 11 serving as a refrigerant flow path switching device, a heat source side heat exchanger 12, check valves 13*a*, 13*b*, 13*c*, and 13*d*, a gas-liquid separator 14, intermediate heat exchangers 15*a* and 15*b*, expansion valves 16*a*, 16*b*, 16*c*, 16*d*, and 16*e* serving as expanding devices, such as electronic expansion valves, and an accumulator 17 which are connected by piping to constitute a refrigeration cycle circuit. In this case, the intermediate heat exchanger 15*a* corresponds to a first heat exchanger. The intermediate heat exchanger 15*b* corresponds to a second heat exchanger.

In addition, the intermediate heat exchangers 15*a* and 15*b*, pumps 21*a* and 21*b*, each serving as a heat medium delivery device, three-way valves 22*a*, 22*b*, 22*c*, 22*d*, 23*a*, 23*b*, 23*c*, and 23*d*, each serving as a heat medium flow path switching device, stop valves 24*a*, 24*b*, 24*c*, and 24*d*, each serving as a heat medium flow path opening and closing device, three-way valves 25*a*, 25*b*, 25*c*, and 25*d*, use side heat exchangers 26*a*, 26*b*, 26*c*, and 26*d*, and bypasses 27*a*, 27*b*, 27*c*, and 27*d* are connected by piping, thus constituting a heat medium circulation circuit.

In this case, the three-way valves 22*a*, 22*b*, 22*c*, 22*d*, 23*a*, 23*b*, 23*c*, and 23*d* each correspond to a heat medium flow rate adjusting unit. The three-way valves 25*a*, 25*b*, 25*c*, and 25*d* each correspond to a heat medium flow rate adjusting device. The bypasses 27*a*, 27*b*, 27*c*, and 27*d* each correspond to a heat medium bypass pipe. The three-way valves 25*a*, 25*b*, 25*c*, and 25*d* and the bypasses 27*a*, 27*b*, 27*c*, and 27*d* correspond to the heat medium adjusting units. In Embodiment 1, the number of indoor units 2 (use side heat exchangers 26) is four. The number of indoor units 2 (use side heat exchangers 26) may be any number.

In Embodiment 1, the compressor 10, the four-way valve 11, the heat source side heat exchanger 12, the check valves

13*a*, 13*b*, 13*c*, and 13*d*, and the accumulator 17 are accommodated in a heat source unit 1 (outdoor unit). Further, the heat source unit 1 receives a controller 50 that controls the entire air-conditioning apparatus. The use side heat exchangers 26*a*, 26*b*, 26*c*, and 26*d* are accommodated in indoor units 2*a*, 2*b*, 2*c*, and 2*d*, respectively. The gas-liquid separator 14 and the expansion valves 16*a*, 16*b*, 16*c*, 16*d*, and 16*e* are accommodated in a relay unit 3 (branch unit), serving as a heat medium exchanger. In addition, the relay unit 3 includes temperature sensors 31*a* and 31*b*, temperature sensors 32*a* and 32*b*, temperature sensors 33*a*, 33*b*, 33*c*, and 33*d*, temperature sensors 34*a*, 34*b*, 34*c*, and 34*d*, a temperature sensor 35, a pressure sensor 36, a temperature sensor 37, a temperature sensor 38, and temperature sensors 39*a*, 39*b*, 39*c*, and 39*d* which will be described later.

Furthermore, the heat source unit 1 is connected to the relay unit 3 through refrigerant pipes 4. Moreover, the relay unit 3 is connected to each of the indoor units 2*a*, 2*b*, 2*c*, and 2*d* (each of the use side heat exchangers 26*a*, 26*b*, 26*c*, and 26*d*) through heat medium pipes 5 through which a safe heat medium, such as water or antifreeze, flows. In other words, the relay unit 3 is connected to each of the indoor units 2*a*, 2*b*, 2*c*, and 2*d* (each of the use side heat exchangers 26*a*, 26*b*, 26*c*, and 26*d*) through a single heat medium path. The destinations of the refrigerant pipes 4 and the heat medium pipes 5 will be described in detail later upon description of the operation modes, which will be described below.

The compressor 10 pressurizes an input refrigerant and discharges (delivers) it. Further, the four-way valve 11, serving as the refrigerant flow path switching device, selects a valve for an operation mode related to cooling or heating in accordance with an instruction from the controller 50 to change a refrigerant path. In Embodiment 1, a circulation path changes among a cooling only operation (during which all of the operating indoor units 2 perform cooling (including dehumidifying; the same applies to the following description), a cooling-main operation (during which cooling is dominant when the indoor units 2 performing cooling and heating exist simultaneously), a heating only operation (during which all of the operating indoor units 2 perform heating), and a heating-main operation (during which heating is dominant when the indoor units 2 performing cooling and heating exist simultaneously).

The heat source side heat exchanger 12 includes fins (not illustrated) for increasing the area of heat transfer between, for example, a heat transfer tube through which the refrigerant passes and the refrigerant flowing therethrough, and the outside air so as to exchange heat between the refrigerant and the air (outside air). For example, the heat source side heat exchanger 12 functions as an evaporator in the heating only operation and the heating-main operation to evaporate the refrigerant into a gas (vapor). On the other hand, the heat source side heat exchanger 12 functions as a condenser in the cooling only operation and the cooling-main operation. In some cases, the heat source side heat exchanger 12 does not fully exchange the refrigerant into a gas or liquid and produces a two-phase mixture of gas and liquid (gas-liquid two-phase refrigerant).

The check valves 13*a*, 13*b*, 13*c*, and 13*d* prevent backflow of the refrigerant to adjust the flow of the refrigerant, thus providing a constant circulation path for the inflow and outflow of the refrigerant in the heat source unit 1. The gas-liquid separator 14 separates the refrigerant flowing out of the refrigerant pipe 4 into a gasified refrigerant (gas refrigerant) and a liquefied refrigerant (liquid refrigerant). The intermediate heat exchangers 15*a* and 15*b* each include a heat transfer tube through which the refrigerant passes and a heat transfer tube through which the heat medium passes so as to perform inter-medium heat exchange between the refrigerant and the heat medium. In Embodiment 1, the intermediate heat exchanger 15*a* functions as a condenser in the heating only operation, the cooling-main operation, and the heating-main operation to allow the refrigerant to dissipate heat and heat the heat medium. The intermediate heat exchanger 15*b* functions as an evaporator in the cooling only operation, the cooling-main operation, and the heating-main operation to allow the refrigerant to absorb heat and cool the heat medium. For example, the expansion valves 16*a*, 16*b*, 16*c*, 16*d*, and 16*e*, such as electronic expansion valves, each adjust the flow rate of the refrigerant to reduce a pressure of the refrigerant. The accumulator 17 has a function of accumulating excess refrigerant in the refrigeration cycle circuit and a function of preventing the compressor 10 from being damaged by a large amount of refrigerant returned to the compressor 10.

The pumps 21*a* and 21*b*, each serving as the heat medium delivery device, pressurize the heat medium to circulate it. In this case, regarding the pumps 21*a* and 21*b*, a rotation speed of a motor (not illustrated) built therein is changed within a predetermined range, so that the flow rate (discharge flow rate) of the heat medium delivered can be changed. Further, the use side heat exchangers 26*a*, 26*b*, 26*c*, and 26*d* in the indoor units 2*a*, 2*b*, 2*c*, and 2*d* exchange heat between the heat medium and the air in an air-conditioning target space to heat or cool the air in the air-conditioning target space.

The three-way valves 22*a*, 22*b*, 22*c*, and 22*d* are connected by piping to heat medium inlets of the use side heat exchangers 26*a*, 26*b*, 26*c*, and 26*d*, respectively, to change a flow path on the side (heat medium inflow side) of the inlets of the use side heat exchangers 26*a*, 26*b*, 26*c*, and 26*d*. Moreover, the three-way valves 23*a*, 23*b*, 23*c*, and 23*d* are connected by piping to the heat medium outflow side of the use side heat exchangers 26*a*, 26*b*, 26*c*, and 26*d* to change a flow path on the side (heat medium outflow side) of the outlets of the use side heat exchangers 26*a*, 26*b*, 26*c*, and 26*d*. These switching devices are configured to perform switching in order to allow either the heat medium related to heating or the heat medium related to cooling to pass through the use side heat exchangers 26*a*, 26*b*, 26*c*, and 26*d*. Further, the stop valves 24*a*, 24*b*, 24*c*, and 24*d* are opened or closed to allow or prevent the passage of the heat medium through the use side heat exchangers 26*a*, 26*b*, 26*c*, and 26*d*.

Furthermore, the three-way valves 25*a*, 25*b*, 25*c*, and 25*d* each adjust the ratio of the heat medium passing through the corresponding one of the use side heat exchangers 26*a*, 26*b*, 26*c*, and 26*d* to that through the corresponding one of the bypasses 27*a*, 27*b*, 27*c*, and 27*d*. The bypasses 27*a*, 27*b*, 27*c*, and 27*d* allow the passage of the heat medium which do not flow through the use side heat exchangers 26*a*, 26*b*, 26*c*, and 26*d* under the adjustment of the three-way valves 25*a*, 25*b*, 25*c*, and 25*d*.

Each of the temperature sensors 31*a* and 31*b*, each serving as a heat medium temperature detecting device detecting a temperature of the heat medium, detects a temperature of the heat medium on the side (heat medium outflow side) of a heat medium outlet of the corresponding one of the intermediate heat exchangers 15*a* and 15*b*. Further, each of the temperature sensors 32*a* and 32*b*, each serving as a heat medium temperature detecting device detecting a temperature of the heat medium, also detects a temperature of the heat medium on the side (heat medium inflow side) of a heat medium inlet of the corresponding one of the intermediate heat exchangers 15*a* and 15*b*. Each of the temperature sensors 33*a*, 33*b*, 33*c*, and 33*d*, each serving as a heat medium temperature detecting device detecting a temperature of the heat medium, detects a temperature of the heat medium flowing into the corresponding one of the use side heat exchangers 26*a*, 26*b*, 26*c*, and 26*d*. Each of the temperature sensors 34*a*, 34*b*, 34*c*, and 34*d*, each serving as a heat medium temperature detecting device detecting a temperature of the heat medium, detects a temperature of the heat medium flowing out of the corresponding one of the use side heat exchangers 26*a*, 26*b*, 26*c*, and 26*d*. In addition, each of the temperature sensors 39*a*, 39*b*, 39*c*, and 39*d*, each serving as a heat medium temperature detecting device detecting a temperature of the heat medium, detects a temperature of the heat medium flowing out of the corresponding one of the three-way valves 25*a*, 25*b*, 25*c*, and 25*d*. In the following description, when the same means, e.g., the temperature sensors 34*a*, 34*b*, 34*c*, and 34*d*, are not especially distinguished from one another, for example, subscripts are omitted or they are represented as the temperature sensors 34*a* to 34*d*. The same applies to other devices and means.

The temperature sensor 35, serving as a refrigerant temperature detecting device detecting a temperature of the refrigerant, detects a temperature of the refrigerant on the side (refrigerant outflow side) of a refrigerant outlet of the intermediate heat exchanger 15*a*. The pressure sensor 36, serving as a refrigerant pressure detecting device, detects a pressure of the refrigerant on the side (refrigerant outflow side) of the refrigerant outlet of the intermediate heat exchanger 15*a*. Further, the temperature sensor 37, serving as a refrigerant temperature detecting device detecting a temperature of the refrigerant, detects a temperature of the refrigerant on the side (refrigerant inflow side) of a refrigerant inlet of the intermediate heat exchanger 15*b*. In addition, the temperature sensor 38, serving as a refrigerant temperature detecting device detecting a temperature of the refrigerant, detects a temperature of the refrigerant on the side (refrigerant outflow side) of a refrigerant outlet of the intermediate heat exchanger 15*b*.

<Operation Modes>

An operation of the air-conditioning apparatus in each operation mode will now be described on the basis of the flow of the refrigerant and the heat medium. In this case, it is assumed that the level of a pressure in the refrigeration cycle circuit or the like is not determined in relation to a reference pressure and a relative pressure increased by the compressor 10, refrigerant flow control by, for example, the expansion valves 16*a* to 16*e*, or the like is expressed as a high or low pressure. The same applies to the level of a temperature.

(Cooling Only Operation)

Figure 2:
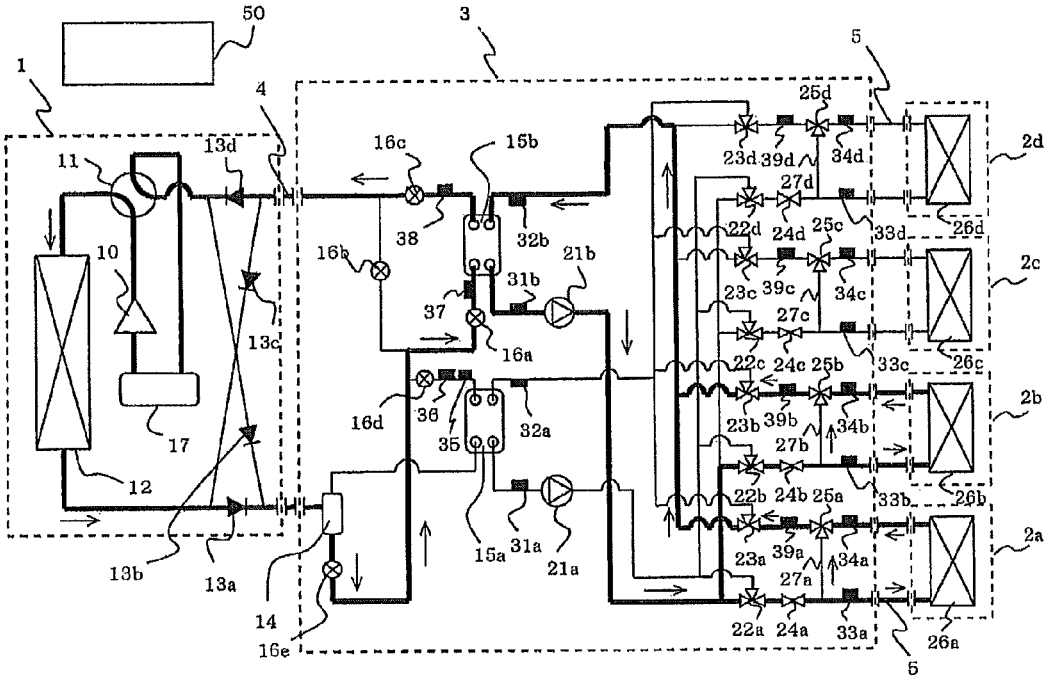
FIG. 2 is a system circuit diagram in a cooling only operation of the air-conditioning apparatus according to Embodiment 1 of the present invention.

FIG. 2 is a system circuit diagram in the cooling only operation of the air-conditioning apparatus according to Embodiment 1 of the present invention. In the following description, a case where the indoor units 2*a* and 2*b* (use side heat exchangers 26*a* and 26*b*) are in the cooling operation and the indoor units 2*c* and 2*d* (use side heat exchangers 26*c* and 26*d*) are turned off will be explained. The flow of the refrigerant in the refrigeration cycle circuit will be first described. In the heat source unit 1, the refrigerant taken into the compressor 10 is compressed and is discharged as a high-pressure gas refrigerant. The refrigerant discharged from the compressor 10 flows through the four-way valve 11 into the heat source side heat exchanger 12, functioning as a condenser. The high-pressure gas refrigerant is condensed by heat exchange with the output air while passing through the heat source side heat exchanger 12 and flows as a high-pressure liquid refrigerant out thereof and then flows through the check valve 13*a* (the refrigerant does not flow through the check valves 13*b* and 13*c* in relation to a pressure of the refrigerant). The refrigerant further passes through the refrigerant pipe 4 and flows into the relay unit 3.

The refrigerant flowing into the relay unit 3 passes through the gas-liquid separator 14. Since the liquid refrigerant flows into the relay unit 3 in the cooling only operation, a gas refrigerant does not flow through the intermediate heat exchanger 15*a*. Accordingly, the intermediate heat exchanger 15*a* does not function. On the other hand, the liquid refrigerant passes through the expansion valves 16*e* and 16*a* and then flows into the intermediate heat exchanger 15*b*. At this time, an opening-degree of the expansion valve 16*a* is controlled to adjust the flow rate of the refrigerant, thus reducing a pressure of the refrigerant. Accordingly, the low-temperature low-pressure gas-liquid two-phase refrigerant flows into the intermediate heat exchanger 15*b*.

Since the intermediate heat exchanger 15*b* functions as an evaporator for the refrigerant, the refrigerant passing through the intermediate heat exchanger 15*b* flows as a low-temperature low-pressure gas refrigerant out thereof while cooling the heat medium as a heat exchange target (while absorbing heat from the heat medium). The gas refrigerant flowing out of the intermediate heat exchanger 15*b* passes through the expansion valve 16*c* and then flows out of the relay unit 3. Then, the gas refrigerant passes through the refrigerant pipe 4 and flows into the heat source unit 1. In this case, the expansion valves 16*b* and 16*d* in the cooling only operation are set to have such an opening-degree that the refrigerant does not flow. On the other hand, the expansion valves 16*c* and 16*e* are fully opened to prevent damage caused by pressure.

The refrigerant flowing into the heat source unit 1 passes through the check valve 13*d* and is again sucked into the compressor 10 through the four-way valve 11 and the accumulator 17.

The flow of the heat medium in the heat medium circulation circuit will now be described. In FIG. 2, it is unnecessary to allow the heat medium to pass through the use side heat exchangers 26*c* and 26*d* in the indoor units 2*c* and 2*d* where it is unnecessary to deliver heat because they are tuned off. Accordingly, the stop valves 24*c* and 24*d* are closed so that no heat medium flows into the use side heat exchangers 26*c* and 26*d*.

The heat medium is cooled by heat exchange with the refrigerant in the intermediate heat exchanger 15*b*. Then, the heat medium related to cooling is sucked and discharged by the pump 21*b*. The heat medium, discharged from the pump 21*b*, passes through the three-way valves 22*a* and 22*b* and the stop valves 24*a* and 24*b*. After that, the heat medium sufficient to cover (supply) heat necessary for work of cooling the air in an air-conditioning target space flows into the use side heat exchangers 26*a* and 26*b* by adjustment of the flow rate of each of the three-way valves 25*a* and 25*b*. At this time, the opening-degree of each of the three-way valves 25*a* and 25*b* (the ratio of the heat medium passing through each of the use side heat exchangers 26*a* and 26*b* to that through the corresponding one of the bypasses 27*a* and 27*b*) is adjusted so that each of the difference between a temperature detected by the temperature sensor 33*a* and that detected by the temperature sensor 34*a* and the difference between a temperature detected by the temperature sensor 33*b* and that detected by the temperature sensor 34*b* approaches a set target value.

The heat medium flowing into each of the use side heat exchangers 26*a* and 26*b* exchanges heat with the air in the air-conditioning target space and then flows out thereof. On the other hand, the remaining heat medium, which does not flow into each of the use side heat exchangers 26*a* and 26*b*, passes through the corresponding one of bypasses 27*a* and 27*b* without contributing to air conditioning in the air-conditioning target space.

The heat medium flowing out of the use side heat exchangers 26*a* and 26*b* and the heat medium passing through the bypasses 27*a* and 27*b* join together in the three-way valves 25*a* and 25*b*. Then, the resultant heat medium passes through the three-way valves 23*a* and 23*b* and flows into the intermediate heat exchanger 15*b*. The heat medium cooled in the intermediate heat exchanger 15*b* is again sucked and discharged by the pump 21*b*.

(Heating Only Operation)

Figure 3:
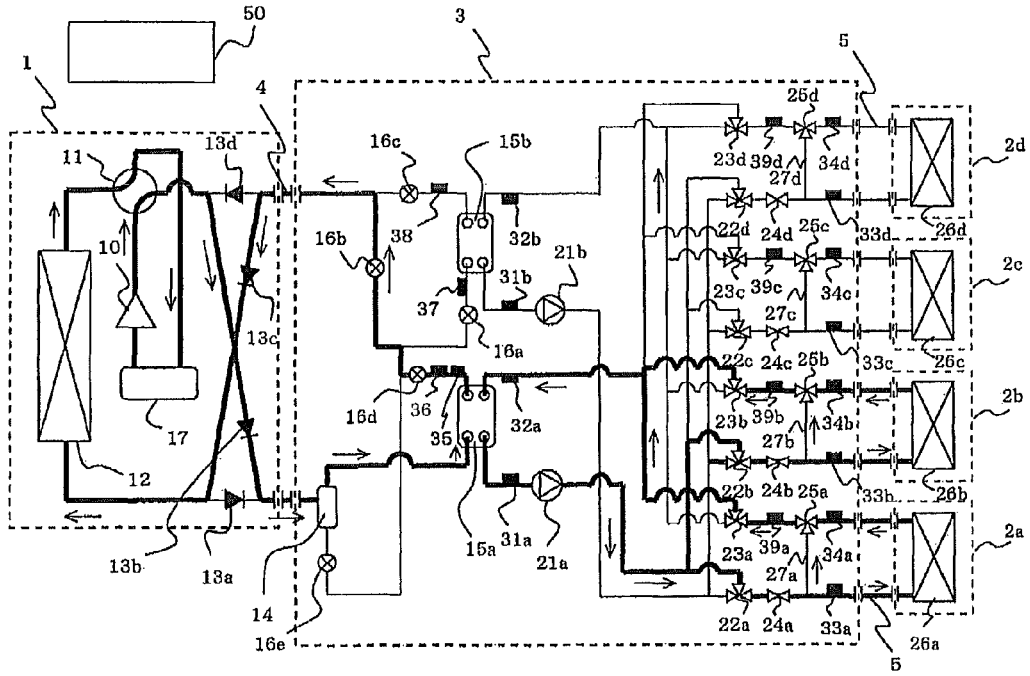
FIG. 3 is a system circuit diagram in a heating only operation of the air-conditioning apparatus according to Embodiment 1 of the present invention.

FIG. 3 is a system circuit diagram in the heating only operation of the air-conditioning apparatus according to Embodiment 1 of the present invention. In the following description, it will be explained that the indoor units 2*a* and 2*b* (use side heat exchangers 26*a* and 26*b*) are in the heating operation and the indoor units 2*c* and 2*d* (use side heat exchangers 26*c* and 20*d*) are turned off. The flow of the refrigerant in the refrigeration cycle circuit will be first described. In the heat source unit 1, the refrigerant taken into the compressor 10 is compressed and discharged as a high-pressure gas refrigerant. The refrigerant, discharged from the compressor 10, flows through the four-way valve 11 and the check valve 13*b*. The refrigerant further passes through the refrigerant pipe 4 and flows into the relay unit 3.

The gas refrigerant, flowing into the relay unit 3, passes through the gas-liquid separator 14 and flows into the intermediate heat exchanger 15*a*. Since the intermediate heat exchanger 15*a* functions as a condenser for the refrigerant, the refrigerant passing through the intermediate heat exchanger 15*a* heats the heat medium as a heat exchange target (dissipates heat to the heat medium) and flows as a liquid refrigerant out thereof.

The refrigerant flowing out of the intermediate heat exchanger 15*a* passes through the expansion valves 16*d* and 16*b*, flows out of the relay unit 3, passes through the refrigerant pipe 4, and flows into the heat source unit 1. At this time, the opening-degree of the expansion valve 16*b* or 16*d* is controlled to adjust the flow rate of the refrigerant, thus reducing a pressure of the refrigerant. Consequently, the low-temperature low-pressure gas-liquid two-phase refrigerant flows out of the relay unit 3. In this case, the expansion valves 16*a* or 16*c* and 16*e* in the heating only operation are set to be such an opening-degree that the refrigerant does not flow.

The refrigerant flowing into the heat source unit 1 passes through the check valve 13*c* and flows into the heat source side heat exchanger 12, functioning as an evaporator. The low-temperature low-pressure gas-liquid two-phase refrigerant evaporates by heat exchange with the output air while passing though the heat source side heat exchanger 12, resulting in a low-temperature low-pressure gas refrigerant. The refrigerant flowing out of the heat source side heat exchanger 12 passes through the four-way valve 11 and the accumulator 17 and is again sucked into the compressor 10.

Next, the flow of the heat medium in the heat medium circulation circuit will be described. In this case, in FIG. 3, it is unnecessary to allow the heat medium to pass through the use side heat exchangers 26*c* and 26*d* in the indoor units 2*c* and 2*d* in which it is unnecessary to deliver heat because they are turned off (in a state where it is unnecessary to heat the air-conditioning target space, the state including a thermo-off state). Accordingly, the stop valves 24*c* and 24*d* are closed so that the heat medium does not flow into the use side heat exchangers 26*c* and 26*d*.

The heat medium is heated by heat exchange with the refrigerant in the intermediate heat exchanger 15*a*. Then, the heated heat medium is sucked and discharged by the pump 21*a*. The heat medium, discharged from the pump 21*a*, passes through the three-way valves 22*a* and 22*b* and the stop valves 24*a* and 24*b*. After that, the heat medium sufficient to cover (supply) heat necessary for work of heating the air in the air-conditioning target space flows into the use side heat exchangers 26*a* and 26*b* by adjusting the flow rate of the three-way valves 25*a* and 25*b*. At this time, the opening-degree of the three-way valves 25*a* and 25*b* (the ratio of the heat medium passing through the use side heat exchangers 26*a* and 26*b* to that passing through the bypasses 27*a* and 27*b*) is adjusted so that each of the difference between a temperature detected by the temperature sensor 33*a* and that detected by the temperature sensor 34*a* and the difference between a temperature detected by the temperature sensor 33*b* and that detected by the temperature sensor 34*b* approaches a set target value.

The heat medium flowing into each of the use side heat exchangers 26*a* and 26*b* exchanges heat with the air in the air-conditioning target space and then flows out thereof. On the other hand, the remaining heat medium, which does not flow into each of the use side heat exchangers 26*a* and 26*b*, passes through the corresponding one of the bypasses 27*a* and 27*b* without contributing to air conditioning in the air-conditioning target space.

The heat medium flowing out of the use side heat exchangers 26*a* and 26*b* and the heat medium passing through the bypasses 27*a* and 27*b* join together in the three-way valves 25*a* and 25*b*. Then, the resultant heat medium passes through the three-way valves 23*a* and 23*b* and flows into the intermediate heat exchanger 15*a*. The heat medium heated in the intermediate heat exchanger 15*a* is again sucked and discharged by the pump 21*a*.

(Cooling-Main Operation)

Figure 4:
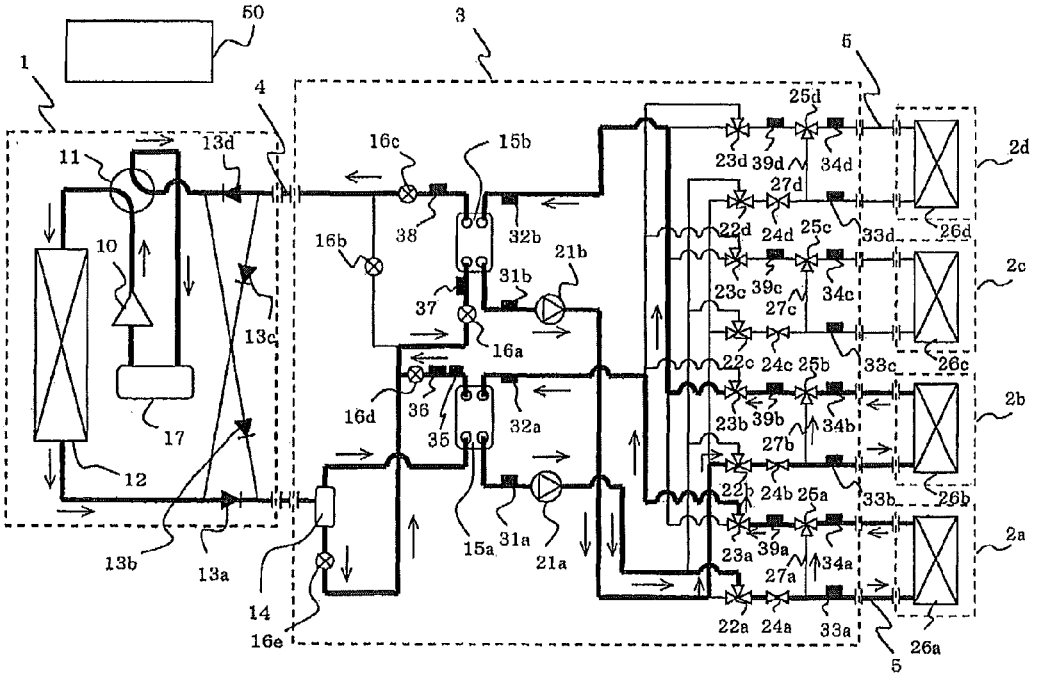
FIG. 4 is a system circuit diagram in a cooling-main operation of the air-conditioning apparatus according to Embodiment 1 of the present invention.

FIG. 4 is a system circuit diagram in the cooling-main operation of the air-conditioning apparatus according to Embodiment 1 of the present invention. In the following description, a case where the indoor unit 2*a* (the use side heat exchanger 26*a*) performs heating, the indoor unit 2*b* (the use side heat exchanger 26*b*) performs cooling, and the indoor units 2*c* and 2*d* (the use side heat exchangers 26*c* and 26*d*) are turned off will be explained. The flow of the refrigerant in the refrigeration cycle circuit will be first described. In the heat source unit 1, the refrigerant taken into the compressor 10 is compressed and is discharged as a high-pressure gas refrigerant. The refrigerant discharged from the compressor 10 flows through the four-way valve 11 into the heat source side heat exchanger 12. The high-pressure gas refrigerant is condensed by heat exchange with the output air while passing through the heat source side heat exchanger 12. At this time, in the cooling-main operation, a gas-liquid two-phase refrigerant flows out of the heat source side heat exchanger 12. The gas-liquid two-phase refrigerant flowing out of the heat source unit 12 flows through the check valve 13*a*. The refrigerant further passes through the refrigerant pipe 4 and flows into the relay unit 3.

The refrigerant flowing into the relay unit 3 passes through the gas-liquid separator 14. The gas-liquid two-phase refrigerant is separated into a liquid refrigerant and a gas refrigerant in the gas-liquid separator 14. The gas refrigerant separated by the gas-liquid separator 14 flows into the intermediate heat exchanger 15*a*. The refrigerant flowing into the intermediate heat exchanger 15*a* is condensed to a liquid refrigerant while heating the heat medium as a heat exchange target and flows as a liquid refrigerant out thereof and then passes through the expansion valve 16*d*.

On the other hand, the liquid refrigerant separated by the gas-liquid separator 14 passes through the expansion valve 16*e*. Then, the liquid refrigerant joins the liquid refrigerant passed through the expansion valve 16*d*. The resultant refrigerant passes through the expansion valve 16*a* and flows into the intermediate heat exchanger 15*b*. At this time, the opening-degree of the expansion valve 16*a* is controlled to adjust the flow rate of the refrigerant, thus reducing a pressure of the refrigerant. Consequently, a low-temperature low-pressure gas-liquid two-phase refrigerant flows into the intermediate heat exchanger 15*b*. The refrigerant flowing into the intermediate heat exchanger 15*b* is evaporated while cooling the heat medium as a heat exchange target and then flows as a low-temperature low-pressure gas refrigerant out thereof. The gas refrigerant flowing out of the intermediate heat exchanger 15*b* passes through the expansion valve 16*c* and flows out of the relay unit 3. After that, the refrigerant passes through the refrigerant pipe 4 and flows into the heat source unit 1. In this case, the expansion valve 16*b* in the cooling-main operation is set to be such an opening-degree that the refrigerant does not flow. On the other hand, the expansion valve 16*c* is fully opened to prevent damage caused by pressure.

The refrigerant flowing into the heat source unit 1 passes through the check valve 13*d*, the four-way valve 11, and the accumulator 17 and is then again taken into the compressor 10.

Next, the flow of the heat medium in the heat medium circulation circuit will be described. Here, in FIG. 4, it is unnecessary to allow the heat medium to pass through the use side heat exchangers 26*c* and 26*d* in the indoor units 2*c* and 2*d* to which no heat load is applied because they are turned off (in a state in which it is unnecessary to cool or heat the air-conditioning target space, the state including the thermo-off state). Accordingly, the stop valves 24*c* and 24*d* are closed so that no heat medium flows into the use side heat exchangers 26*c* and 26*d*.

The heat medium is cooled by heat exchange with the refrigerant in the intermediate heat exchanger 15*b*. Then, the cooled heat medium is sucked and discharged by the pump 21*b*. In addition, the heat medium is heated by heat exchange with the refrigerant in the intermediate heat exchanger 15*a*. The cooled heat medium is sucked and discharged by the pump 21*a*.

The cooled heat medium discharged from the pump 21*b* passes through the three-way valve 22*b* and the stop valve 24*b*. The heated heat medium discharged from the pump 21*a* passes through the three-way valve 22*a* and the stop valve 24*a*. As described above, the three-way valve 22*a* allows the heated heat medium to pass therethrough and shuts off the cooled heat medium. In addition, the three-way valve 22*b* allows the cooled heat medium to pass therethrough and shuts off the heated heat medium. Consequently, during circulation, the flow path through which the cooled heat medium flows is partitioned and separated from the flow path through which the heated heat medium flows. The cooled heat medium is not mixed with the heated heat medium.

Adjusting the flow rate of each of the three-way valves 25*a* and 25*b* allows the heat medium sufficient to cover (supply) heat necessary for work of cooling or heating the air in the air-conditioning target space to flow into each of the use side heat exchangers 26*a* and 26*b*. In this case, the opening-degree of each of the three-way valves 25*a* and 25*b* (the ratio of the heat medium passing through each of the use side heat exchangers 26*a* and 26*b* to that through the corresponding one of the bypasses 27*a* and 27*b*) is adjusted so that each of the difference between a temperature detected by the temperature sensor 33*a* and that detected by the temperature sensor 34*a* and the difference between a temperature detected by the temperature sensor 33*b* and that detected by the temperature sensor 34*b* reaches a set target value.

The heat medium flowing into each of the use side heat exchangers 26*a* and 26*b* exchanges heat with the air in the air-conditioning target space and then flows out thereof. On the other hand, the remaining heat medium, which does not flow into each of the use side heat exchangers 26*a* and 26*b*, passes through the corresponding one of the bypasses 27*a* and 27*b* without contributing to air conditioning in the air-conditioning target space.

The heat medium flowing out of the use side heat exchanger 26*a* and the heat medium passing through the bypass 27*a* join together in the three-way valve 25*a*. The resultant heat medium further passes through the three-way valve 23*a* and flows into the intermediate heat exchanger 15*a*. The heat medium heated in the intermediate heat exchanger 15*a* is again sucked and discharged by the pump 21*a*.

The heat medium flowing out of the use side heat exchanger 26*b* and the heat medium passing through the bypass 27*b* join together in the three-way valve 25*b*. The resultant heat medium further passes through the three-way valve 23*b* and flows into the intermediate heat exchanger 15*b*. The heat medium cooled in the intermediate heat exchanger 15*b* is again sucked and discharged by the pump 21*b*.

(Heating-Main Operation)

Figure 5:
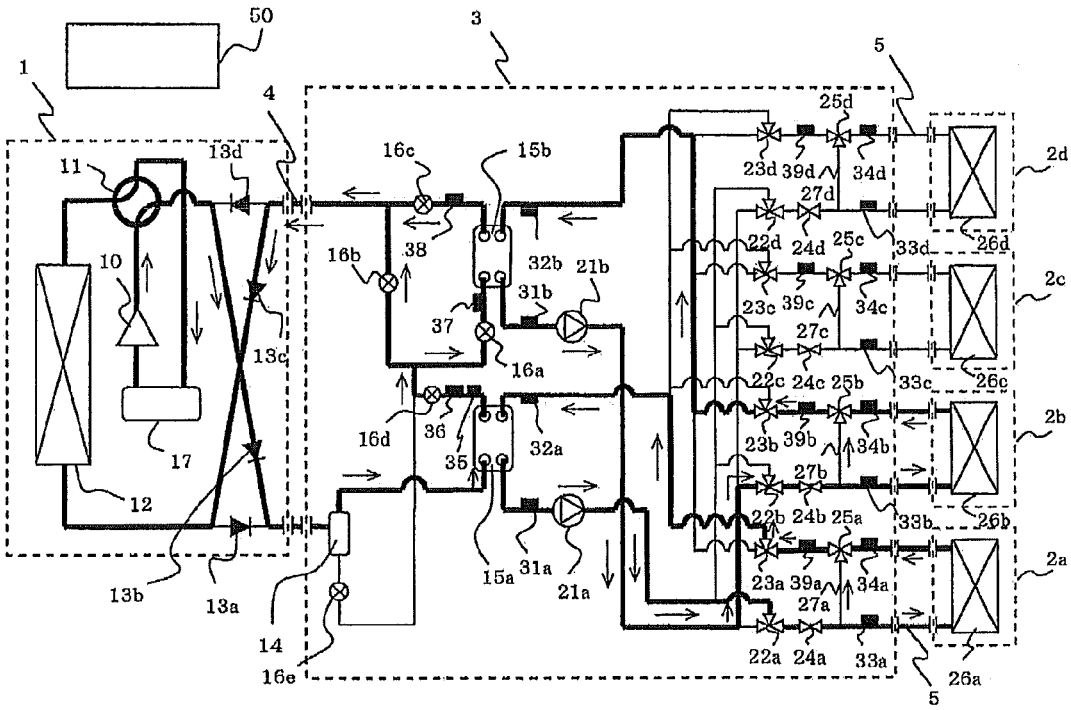
FIG. 5 is a system circuit diagram in a heating-main operation of the air-conditioning apparatus according to Embodiment 1 of the present invention.

FIG. 5 is a system circuit diagram in the heating-main operation of the air-conditioning apparatus according to Embodiment 1 of the present invention. In the following description, a case where the indoor unit 2*a* (the use side heat exchanger 26*a*) performs heating, the indoor unit 2*b* (the use side heat exchanger 26*b*) performs cooling, and the indoor units 2*c* and 2*d* (the use side heat exchangers 26*c* and 26*d*) are turned off will be explained. First, the flow of the refrigerant in the refrigeration cycle circuit will be described. In the heat source unit 1, the refrigerant taken into the compressor 10 is compressed and discharged as a high-pressure gas refrigerant. The refrigerant discharged from the compressor 10 flows through the four-way valve 11 and the check valve 13*b*. The refrigerant further passes through the refrigerant pipe 4 and flows into the relay unit 3.

The refrigerant flowing into the relay unit 3 passes through the gas-liquid separator 14. The gas refrigerant passed through the gas-liquid separator 14 flows into the intermediate heat exchanger 15*a*. The refrigerant flowing into the intermediate heat exchanger 15*a* is condensed to a liquid refrigerant while heating the heat medium as a heat exchange target and flows out thereof. The refrigerant then passes through the expansion valve 16*d*. In this case, the expansion valve 16*e* in the heating-main operation is set to be such an opening-degree that the refrigerant does not flow.

The refrigerant passed through the expansion valve 16*d* further passes through the expansion valves 16*a* and 16*b*. The refrigerant passed through the expansion valve 16*a* flows into the intermediate heat exchanger 15*b*. At this time, the opening-degree of the expansion valve 16*a* is controlled to adjust the flow rate of the refrigerant, thus reducing a pressure of the refrigerant. Consequently, a low-temperature low-pressure gas-liquid two-phase refrigerant flows into the intermediate heat exchanger 15*b*. The refrigerant flowing into the intermediate heat exchanger 15*b* is evaporated while cooling the heat medium as a heat exchange target and flows as a low-temperature low-pressure gas refrigerant out thereof. The gas refrigerant flowing out of the intermediate heat exchanger 15*b* passes through the expansion valve 16*c*. On the other hand, the refrigerant passed through the expansion valve 16*b* becomes a low-temperature low-pressure gas-liquid two-phase refrigerant because the opening-degree of the expansion valve 16*h* is controlled. The refrigerant joins the gas refrigerant passed through the expansion valve 16*c*. This results in a low-temperature low-pressure refrigerant having a higher drying-degree. The resultant refrigerant passes through the refrigerant pipe 4 and flows into the heat source unit 1.

The refrigerant flowing into the heat source unit 1 passes through the check valve 13*c* and flows into the heat source side heat exchanger 12, functioning as an evaporator. The low-temperature low-pressure gas-liquid two-phase refrigerant is evaporated by heat exchange with the output air while passing through the heat source side heat exchanger 12 and then becomes a low-temperature low-pressure gas refrigerant. The refrigerant flowing out of the heat source side heat exchanger 12 passes through the four-way valve 11 and the accumulator 17 and is then again taken into the compressor 10.

Next, the flow of the heat medium in the heat medium circulation circuit will be described. In this case, in FIG. 5, it is unnecessary to allow the heat medium to pass through the use side heat exchangers 26*c* and 26*d* in the indoor units 2*c* and 2*d* to which heat load is not applied because they are turned off (in a state where it is unnecessary to cool or heat the air-conditioning target space, the state including the thermo-off state). Accordingly, the stop valves 24*c* and 24*d* are closed so that the heat medium does not flow into the use side heat exchangers 26*c* and 26*d*.

The heat medium is cooled by heat exchange with the refrigerant in the intermediate heat exchanger 15*b*. Then, the cooled heat medium is sucked and discharged by the pump 21*b*. Further, the heat medium is heated by heat exchange with the refrigerant in the intermediate heat exchanger 15*a*. The cooled heat medium is sucked and discharged by the pump 21*a*.

The cooled heat medium discharged from the pump 21*b* passes through the three-way valve 22*b* and the stop valve 24*b*. On the other hand, the heated heat medium discharged from the pump 21*a* passes through the three-way valve 22*a* and the stop valve 24*a*. As described above, the three-way valve 22*a* allows the heated heat medium to pass therethrough and shuts off the cooled heat medium. On the other hand, the three-way valve 22*b* allows the cooled heat medium to pass therethrough and shuts off the heated heat medium. Consequently, the cooled heat medium and the heated heat medium are separated from each other and are not mixed with each other during circulation.

Adjusting the flow rate of each of the three-way valves 25*a* and 25*b* allows the heat medium sufficient to cover (supply) heat necessary for work of cooling or heating the air in the air-conditioning target space to flow into each of the use side heat exchangers 26*a* and 26*b*. In this case, the opening-degree of each of the three-way valves 25*a* and 25*b* (the ratio of the heat medium passing through each of the use side heat exchangers 26*a* and 26*b* to that through the corresponding one of the bypasses 27*a* and 27*b*) is adjusted so that each of the difference between a temperature detected by the temperature sensor 33*a* and that detected by the temperature sensor 34*a* and the difference between a temperature detected by the temperature sensor 33*b* and that detected by the temperature sensor 34*b* reaches a set target value.

The heat medium flowing into each of the use side heat exchangers 26*a* and 26*b* exchanges heat with the air in the air-conditioning target space and then flows out thereof. On the other hand, the remaining heat medium, which does not flow into each of the use side heat exchangers 26*a* and 26*b*, passes through the corresponding one of the bypasses 27*a* and 27*b* without contributing to air conditioning in the air-conditioning target space.

The heat medium flowing out of the use side heat exchanger 26*a* and the heat medium passed through the bypass 27*a* join together in the three-way valve 25*a*. The resultant heat medium further passes through the three-way valve 23*a* and flows into the intermediate heat exchanger 15*a*. The heat medium heated in the intermediate heat exchanger 15*a* is again sucked and discharged by the pump 21*a*.

The heat medium discharged from the use side heat exchanger 26*b* and the heat medium passed through the bypass 27*b* join together in the three-way valve 25*b*. The resultant heat medium further passes through the three-way valve 23*b* and flows into the intermediate heat exchanger 15*b*. The heat medium cooled in the intermediate heat exchanger 15*b* is again sucked and discharged by the pump 21*b*.

As described above, the use side heat exchanger 26 installed in the air-conditioning target space to be heated is switched to a flow path connected to the intermediate heat exchanger 15*a* and the use side heat exchanger 26 installed in the air-conditioning target space to be cooled is switched to a flow path connected to the intermediate heat exchanger 15*b*, so that the heating operation or the cooling operation can be freely performed in each of the indoor units 2*a* to 2*d* (the use side heat exchangers 26*a* to 26*d*).

In Embodiment 1, so long as the three-way valves can switch between the flow paths, they are not limited to the three-way valves 22*a* to 22*d* and the three-way valves 23*a* to 23*d*. For example, two two-way valves, such as on-off valves, may be used in combination to change a flow path instead of each of the three-way valves 22*a* to 22*d* and the three-way valves 23*a* to 23*d*.

Alternatively, each of the three-way valves 22*a* to 22*d* and the three-way valves 23*a* to 23*d* may be a component for changing the flow rate of a three-way flow path such as a stepping-motor-driven mixing valve. Two components for changing the flow rate of a two-way flow path, e.g., electronic expansion valves, may be used in combination instead of each of the three-way valves 22*a* to 22*d* and the three-way valves 23*a* to 23*d*. Adjusting the flow rate using the stepping-motor-driven mixing valve or the electronic expansion valves can prevent water hammer caused when a flow path is suddenly opened or closed.

Then, a low heat load applied to the use side heat exchangers 26*a* to 26*d* results in increase in the heat medium which passes through the bypasses 27*a* to 27*d* to return to the intermediate heat exchanger 15*a* or the intermediate heat exchanger 15*b* with no contribution to heat exchange. In other words, the heat medium returning to the intermediate heat exchanger 15*a* or 15*b* without flowing into the use side heat exchangers 26*a* to 26*d* increases. At this time, the amounts of heat exchanged in the intermediate heat exchangers 15*a* and 15*b* are substantially constant. Disadvantageously, a temperature of the heat medium in the intermediate heat exchanger 15*a* becomes higher than a desired temperature and a temperature of the heat medium in the intermediate heat exchanger 15*b* becomes lower than a desired temperature.

To prevent it, rotation speeds of the pumps 21*a* and 21*b* may be controlled in accordance with a change in heat load applied to the use side heat exchangers 26*a* to 26*d* so that the temperature of the heat medium flowing out of each of the intermediate heat exchangers 15*a* and 15*b*, namely, the temperature detected by each of the temperature sensors 31*a* and 31*b* approaches a target value. When heat load applied to the use side heat exchangers 26*a* to 26*d* decreases, the rotation speeds of the pumps 21*a* and 21*b* are reduced, thus saving energy in the air-conditioning apparatus. When heat load applied to the use side heat exchangers 26*a* to 26*d* rises, the rotation speeds of the pumps 21*a* and 21*b* are increased, so that heat load to the use side heat exchangers 26*a* to 26*d* can be covered. If the rotation speeds of the pumps 21*a* and 21*b* are controlled so that the temperature of the heat medium flowing into each of the intermediate heat exchangers 15*a* and 15*b*, namely, the temperature detected by each of the temperature sensors 32*a* and 32*b* approaches a target value, similar effects can be obtained.

In Embodiment 1, both of the temperature sensor 31*a* or 31*b* and the temperature sensor 32*a* or 32*b* are arranged. Either of the temperature sensor 31*a* or 31*b* and the temperature sensor 32*a* or 32*b* may be disposed.

Note that the pump 21*b* operates when cooling load or dehumidification load occurs in any of the use side heat exchangers 26*a* to 26*d* and is turned off when cooling load and dehumidification load are not applied to any of the use side heat exchangers 26*a* to 26*d*. Further, the pump 21*a* operates when heating load occurs in any of the use side heat exchangers 26*a* to 26*d* and is turned off when there is no heating load in any of the use side heat exchangers 26*a* to 26*d*.

In this case, in the intermediate heat exchanger 15*a* heating the heat medium, the refrigerant dissipates heat to the heat medium, thus heating the heat medium. Accordingly, a temperature of the heat medium on the outlet side (outflow side) detected by the temperature sensor 31*a* is not above a temperature of the refrigerant on the inlet side (inflow side) of the intermediate heat exchanger 15*a*. Further, since the amount of heating in a superheated gas region of the refrigerant is small, a temperature of the heat medium on the outlet side (outflow side) is restricted due to a condensation temperature obtained by a saturation temperature in pressure related to detection by the pressure sensor 36. On the other hand, in the intermediate heat exchanger 15*b* for cooling the heat medium, the refrigerant absorbs heat from the heat medium to cool it. Accordingly, a temperature of the heat medium on the outlet side (outflow side) detected by the temperature sensor 31*b* is not below a temperature of the refrigerant on the inlet side (inflow side) of the intermediate heat exchanger 15*b*. Further, the condensation temperature in the refrigeration cycle circuit for the intermediate heat exchanger 15*a* and an evaporation temperature in the refrigeration cycle circuit for the intermediate heat exchanger 15*b* vary depending on an increase or decrease of heat load on the use side heat exchangers 26*a* to 26*d*.

It is, therefore, preferred to set a control target value of the temperature of the heat medium on the outlet side of the intermediate heat exchanger 15*a* (the temperature of the heat medium detected by the temperature sensor 31*a*) on the basis of the condensation temperature in the refrigeration cycle circuit for the intermediate heat exchanger 15*a*. Moreover, it is preferred to set a control target value of the temperature of the heat medium on the outlet side of the intermediate heat exchanger 15*b* (the temperature of the heat medium detected by the temperature sensor 31*b*) on the basis of the evaporation temperature in the refrigeration cycle circuit for the intermediate heat exchanger 15*b*.

For example, it is assumed that a control target value of the temperature of the heat medium on the outlet side of the intermediate heat exchanger 15*b* (the temperature of the heat medium detected by the temperature sensor 31*b*) is set to 7 degrees C. It is also assumed that the evaporation temperature in the refrigeration cycle circuit for the intermediate heat exchanger 15*b* at this time is 3 degrees C. After that, when the evaporation temperature in the refrigeration cycle circuit for the intermediate heat exchanger 15*b* rises to 7 degrees C., the temperature of the heat medium on the outlet side of the intermediate heat exchanger 15*b* (the temperature of the heat medium detected by the temperature sensor 31*b*) cannot be set to 7 degrees C. Unfortunately, the pump 21*b* or the like cannot be controlled. Therefore, the control target temperature of the temperature of the heat medium on the outlet side of the intermediate heat exchanger 15*b* (the temperature of the heat medium detected by the temperature sensor 31*b*) is raised by, for example, an increase (4 degrees C.) in evaporation temperature, namely, it is set to, for example, 11 degrees C.

Similarly, the control target temperature of the temperature of the heat medium on the outlet side of the intermediate heat exchanger 15*a* (the temperature of the heat medium detected by the temperature sensor 31*a*) is also changed on the basis of an increase or decrease in condensation temperature in the refrigeration cycle circuit for the intermediate heat exchanger 15*a*.

<Method of Suppressing Effect of Turned-on Indoor Unit on Other Indoor Units>

Subsequently, a method (hereinafter, referred to as an "effect suppression method") of suppressing an effect of an indoor unit 2, which has been turned off and starts an operation, on other indoor units 2 will be described.

For example, in winter, when any of the turned-off indoor units 2 is switched to the heating operation, a low-temperature heat medium, staying in the use side heat exchanger 26 accommodated in this indoor unit 2 switched to the heating operation and the heat medium pipe 5 connected thereto, flows into the intermediate heat exchanger 15*a*. Accordingly, this results in a reduction in temperature of the heat medium flowing into the use side heat exchanger 26 accommodated in the indoor unit 2 in the heating operation. On the other hand, when any of the turned-off indoor units 2 is switched to the cooling operation, for example, in summer, a high-temperature heat medium, staying in the use side heat exchanger 26 accommodated in this indoor unit 2 switched to the cooling operation and the heat medium pipe 5 connected thereto, flows into the intermediate heat exchanger 15*a*. Accordingly, this results in an increase in temperature of the heat medium flowing into the use side heat exchanger 26 accommodated in the indoor unit 2 in the cooling operation. Further, as described above, the air-conditioning apparatus according to Embodiment 1 can allow the cooling and heating operations of the indoor units 2*a* to 2*d* to be mixed. In addition, the operation mode of each of the indoor units 2*a* to 2*d* can be easily changed. Accordingly, the above-described problem occurs when any of the indoor units 2 in the cooling operation is switched to the heating operation, alternatively, when any of the indoor units 2 in the heating operation is switched to the cooling operation.

First, a change in heat medium temperature when operation modes are changed from a state where the indoor unit 2*a* is in the heating operation and the indoor unit 2*b* is in an a stop state or in the cooling operation (the state illustrated in FIG. 5) to another state where the indoor units 2*a* and 2*b* are in the heating operation (the state illustrated in FIG. 3) will be described. In other words, a change in heat medium temperature in the case where the operation mode of the indoor unit 2*b* is switched from the stop state to the heating operation or switched from the cooling operation to the heating operation will be described.

For example, it is assumed that while the indoor unit 2*a* is in the heating operation and the indoor unit 2*b* is in the cooling operation, the temperature of the heat medium on the inlet side of the intermediate heat exchanger 15*a* (the temperature detected by the temperature sensor 32*a*) is 40 degrees C. and the temperature of the heat medium on the outlet side of the intermediate heat exchanger 15*a* (the temperature detected by the temperature sensor 31*a*) is 45 degrees C. In addition, it is assumed that the temperature of the heat medium on the inlet side of the intermediate heat exchanger 15*b* (the temperature detected by the temperature sensor 32*b*) is 13 degrees C. and the temperature of the heat medium on the outlet side of the intermediate heat exchanger 15*b* (the temperature detected by the temperature sensor 31*b*) is 7 degrees C.

When the operation mode of the indoor unit 2*b* is switched from the cooling operation to the heating operation, the flow of the low-temperature heat medium into the use side heat exchanger 26*b* is first stopped by the stop valve 24*b*. Then, the three-way valves 22*b* and 23*b* are switched to the heating side (the flow path connected to the intermediate heat exchanger 15*a*). If there is no indoor unit 2 in the cooling operation, the pump 21*b* is also stopped. After that, when the stop valve 24*b* is opened, the low-temperature heat medium staying in the use side heat exchanger 26*b* and the heat medium pipe 5 connected to the use side heat exchanger 26*b* is pushed by a high-temperature heat medium and passes through the three-way valve 23*b*. This low-temperature heat medium joins the heat medium passed through the three-way valve 23*a* and the mixed heat medium flows into the intermediate heat exchanger 15*a*.

For example, when it is assumed that the low-temperature heat medium staying in the use side heat exchanger 26*b* and the heat medium pipe 5 connected to the use side heat exchanger 26*b* is 10 degrees C. (which is the average of the temperature of the heat medium on the inlet side of the intermediate heat exchanger 15*b* and the temperature of the heat medium on the outlet side thereof) and the temperature of the heat medium flowing out of the use side heat exchanger 26*a* is 40 degrees C., a temperature twab of the mixed heat medium is given by the following equation (1):

$$twab=(Vwa/Vwab)\cdot twa+(1-Vwa/Vwab)\cdot twb \quad (1)$$

where Vwa denotes the flow rate of the heat medium passing thought the three-way valve 23*a*, twa indicates the temperature of the heat medium passing through the three-way valve 23*a*, Vwb denotes the flow rate of the heat medium passing through the three-way valve 23*b*, twb indicates the temperature of the heat medium passing through the three-way valve 23*b*, and Vwab denotes the flow rate of the mixed heat medium.

For example, when the flow rate of the heat medium passing through the three-way valve 23*a* is the same as the flow rate of the heat medium passing through the three-way valve 23*b*, the temperature twab of the mixed heat medium is 25 degrees C.

Here, attention is paid to the intermediate heat exchanger 15*a*. In the refrigeration cycle circuit side, the number of use side heat exchangers 26 in the heating operation increases from 1 to 2, so that the amount of heat exchange Qwh between the refrigerant and the heat medium in the intermediate heat exchanger 15*a* is insufficient. To increase the amount of heat exchange Qwh, therefore, the heat source unit 1 increases, for example, the flow rate of refrigerant discharged from the compressor 10. Thus, heating capacity qh per use side heat exchanger 26 in the heating operation can be maintained.

On the other hand, in the heat medium circulation circuit, since the low-temperature heat medium staying in the use side heat exchanger 26*b* and the heat medium pipe 5 connected to the use side heat exchanger 26*b* is mixed with the high-temperature heat medium, the temperature of the heat medium on the inlet side of the intermediate heat exchanger 15*a* decreases from 40 degrees C. to, for example, 25 degrees C. In order to maintain the temperature of the heat medium on the outlet side of the intermediate heat exchanger 15*a* at 45 degrees C., therefore, a rotation speed of the pump 21*a* is reduced. Disadvantageously, the flow rate of the high-temperature heat medium decreases. Therefore, since the flow rate of the heat medium in the use side heat exchanger 26*a* also decreases, the air output temperature of the indoor unit 2*a* which has originally been in the heating operation decreases.

Furthermore, if a decrease in temperature of the heat medium on the inlet side of the intermediate heat exchanger 15*a* is large, a decrease in refrigerant condensing pressure or an increase in refrigerant supercooling-degree occurs in the refrigeration cycle circuit. Accordingly, the proportion of liquid refrigerant increases in the intermediate heat exchanger 15*a*, thus causing, for example, a reduction in heat transfer performance.

Next, a change in heat medium temperature when operation modes are changed from a state where the indoor unit 2*a* is in the stop state or in the heating operation and the indoor unit 2*b* is in the cooling operation (the state illustrated in FIG. 4) to a state where the indoor units 2*a* and 2*b* are in the cooling operation (the state illustrated in FIG. 2) will be described. In other words, a change in heat medium temperature in the case where the operation mode of the indoor unit 2*a* is switched from the stop state to the cooling operation, alternatively, from the heating operation to the cooling operation will be described.

For example, it is assumed that while the indoor unit 2*a* is in the heating operation and the indoor unit 2*b* is in the cooling operation, the temperature of the heat medium on the inlet side of the intermediate heat exchanger 15*a* (the temperature detected by the temperature sensor 32*a*) is 40 degrees C., and the temperature of the heat medium on the outlet side of the intermediate heat exchanger 15*a* (the temperature detected by the temperature sensor 31*a*) is 45 degrees C. In addition, it is assumed that the temperature of the heat medium on the inlet side of the intermediate heat exchanger 15*b* (the temperature detected by the temperature sensor 32*b*) is 13 degrees C. and the temperature of the heat medium on the outlet side of the intermediate heat exchanger 15*b* (the temperature detected by the temperature sensor 31*b*) is 7 degrees C.

When the operation mode of the indoor unit 2*a* is switched from the heating operation to the cooling operation, the flow of the high-temperature heat medium into the use side heat exchanger 26*a* is first stopped by the stop valve 24*a*. Then, the three-way valves 22*a* and 23*a* are switched to the cooling side (the flow path connected to the intermediate heat exchanger 15*b*). If there is no indoor unit 2 in the heating operation, the pump 21*a* is also stopped. After that, when the stop valve 24*a* is opened, the high-temperature heat medium staying in the use side heat exchanger 26*a* and the heat medium pipe 5 connected to the use side heat exchanger 26*a* is pushed by a low-temperature heat medium and passes through the three-way valve 23*a*. This high-temperature heat medium joins the heat medium passed through the three-way valve 23*b* and the mixed heat medium flows into the intermediate heat exchanger 15*b*.

For example, when it is assumed that the high-temperature heat medium staying in the use side heat exchanger 26*a* and the heat medium pipe 5 connected to the use side heat exchanger 26*a* is at 42.5 degrees C. (which is the average of the temperature of the heat medium on the inlet side of the intermediate heat exchanger 15*a* and the temperature of the heat medium on the outlet side thereof), the temperature of the heat medium flowing out of the use side heat exchanger 26*b* is 13 degrees C., and the flow rate of the heat medium passing through the three-way valve 23*a* is the same as the flow rate of the heat medium passing through the three-way valve 23*b*, the temperature twab of the mixed heat medium is 27.8 degrees C. on the basis of Equation (1).

Here, attention is paid to the intermediate heat exchanger 15*b*. In the refrigeration cycle circuit, the number of use side heat exchangers 26 in the cooling operation increases from 1 to 2, so that the amount of heat exchange Qwc between the refrigerant and the heat medium in the intermediate heat exchanger 15*b* is insufficient. To increase the amount of heat exchange Qwc, therefore, the heat source unit 1 increases, for example, the flow rate of refrigerant discharged from the compressor 10. Thus, a cooling capacity qc per use side heat exchanger 26 in the cooling operation can be maintained.

On the other hand, in the heat medium circulation circuit, since the high-temperature heat medium staying in the use side heat exchanger 26*a* and the heat medium pipe 5 connected to the use side heat exchanger 26*a* is mixed with the low-temperature heat medium, the temperature of the heat medium on the inlet side of the intermediate heat exchanger 15*b* increases from 13 degrees C. to, for example, 27.8 degrees C. In order to maintain the temperature of the heat medium on the outlet side of the intermediate heat exchanger 15*b* at 7 degrees C., therefore, a rotation speed of the pump 21*b* is reduced. Disadvantageously, the flow rate of the low-temperature heat medium decreases. Therefore, since the flow rate of the heat medium in the use side heat exchanger 26*b* also decreases, the air output temperature of the indoor unit 2*b* which has originally been in the cooling operation increases.

Furthermore, if an increase in heat medium temperature on the inlet side of the intermediate heat exchanger 15*b* is large, an increase in refrigerant evaporating pressure or an increase in refrigerant superheating-degree occurs in the refrigeration cycle circuit. Accordingly, the proportion of gas refrigerant increases in the intermediate heat exchanger 15*b*, thus causing, for example a reduction in heat transfer performance.

Further, when an increase in refrigerant supercooling-degree in the intermediate heat exchanger 15*a* or an increase in superheating-degree in the intermediate heat exchanger 15*b* increases, a distribution of refrigerant in the refrigeration cycle circuit significantly changes. This causes a disadvantage in that it takes time to stabilize the condensing pressure of the refrigerant flowing through the intermediate heat exchanger 15*a* and the evaporating pressure of the refrigerant flowing through the intermediate heat exchanger 15*b* to target pressures.

In the air-conditioning apparatus according to the present embodiment, therefore, the effect of a certain indoor unit 2, which has been turned off and starts an operation or changes an operation mode, on the other indoor units 2 is suppressed by the following method. Specifically, the temperature sensors 39*a* to 39*d* are arranged on the outlets of the three-way valves 25*a* to 25*d*, respectively. When any of the indoor units 2*a* to 2*d* starts an operation or changes an operation mode, the flow rate of the heat medium flowing into each of the use side heat exchangers 26*a* to 26*d* is adjusted on the basis of a temperature detected by the corresponding one of the temperature sensors 39*a* to 39*d*. Consequently, a change in air output temperature of each of the indoor units 2*a* to 2*d* is suppressed.

First, the effect suppression method will be described with respect to a case where operation modes are changed from a state where the indoor unit 2*a* is in the heating operation and the indoor unit 2*b* is in the stop state or in the cooling operation (the state illustrated in FIG. 5) to a state where the indoor units 2*a* and 2*b* are in the heating operation (the state illustrated in FIG. 3). In other words, the effect suppression method in the case where the operation mode of the indoor unit 2*b* is switched from the stop state to the heating operation, alternatively, from the cooling operation to the heating operation will be described.

Figure 7:
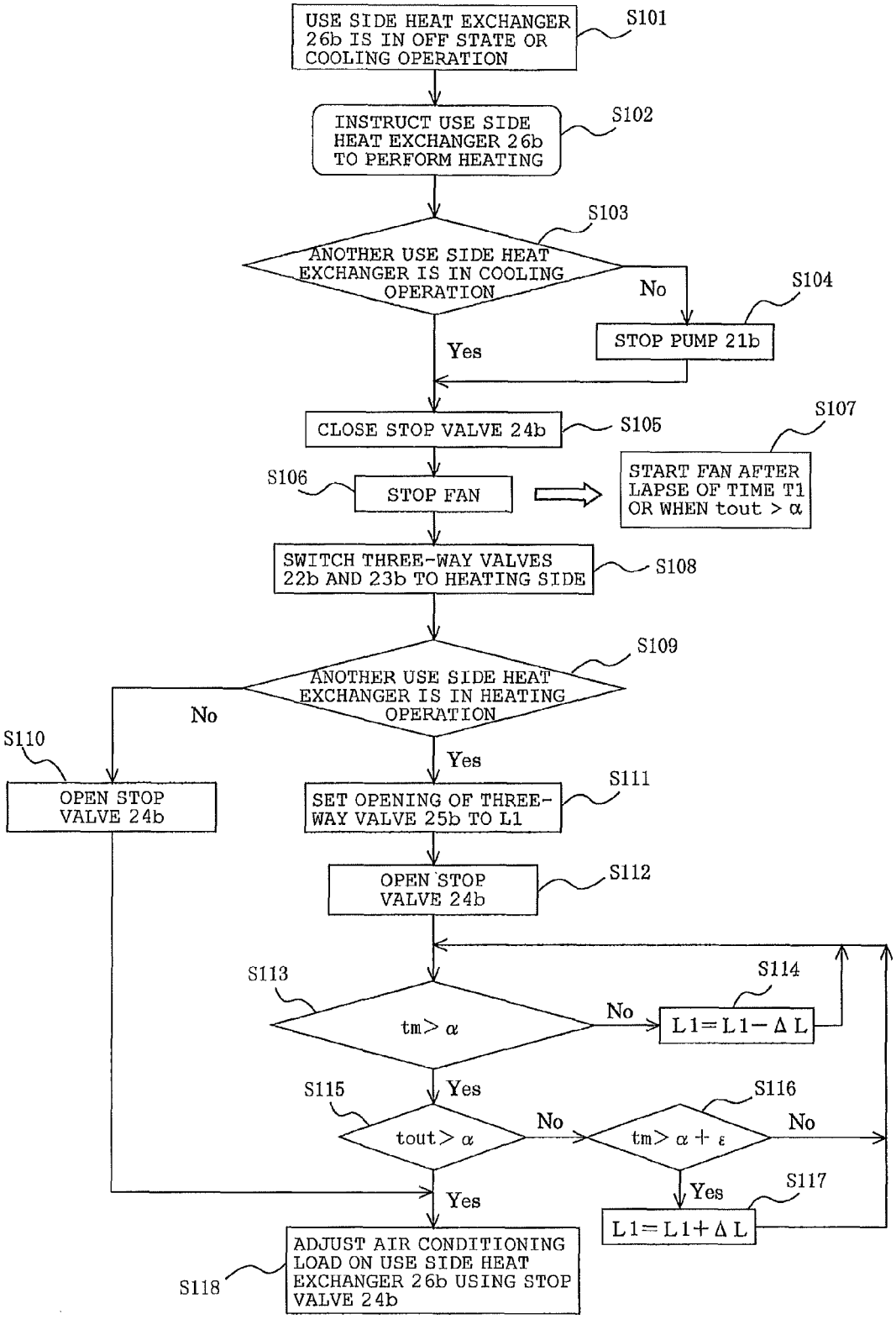
FIG. 7 is a flowchart illustrating a method of effect suppression according to Embodiment 1 of the present invention.

FIG. 7 is a flowchart illustrating the effect suppression method according to Embodiment 1 of the present invention.

When the indoor unit 2*b* (use side heat exchanger 26*b*), which is in the stop state or in the cooling operation (step S101), is switched to the heating operation (step S102), the controller 50 determines whether another indoor unit 2 (use side heat exchanger 26) is in the cooling operation (step S103). If another indoor unit 2 (use side heat exchanger 26) is not in the cooling operation, the procedure goes to step S104 to stop the pump 21*b* and then proceeds to step S105. If another indoor unit 2 (use side heat exchanger 26) is in the cooling operation, the procedure goes to step S105 to close the stop valve 24*b*. Then, the procedure goes to step S106 to stop the fan (not illustrated) in the indoor unit 2*b*. Conditions for again starting the fan (S107) will be described later. In step S108, the three-way valves 22*b* and 23*b* are switched to the heating side (the flow path connected to the intermediate heat exchanger 15*a*). In step S109, the controller determines whether another indoor unit 2 (use side heat exchanger 26) is in the heating operation.

Figure 6:
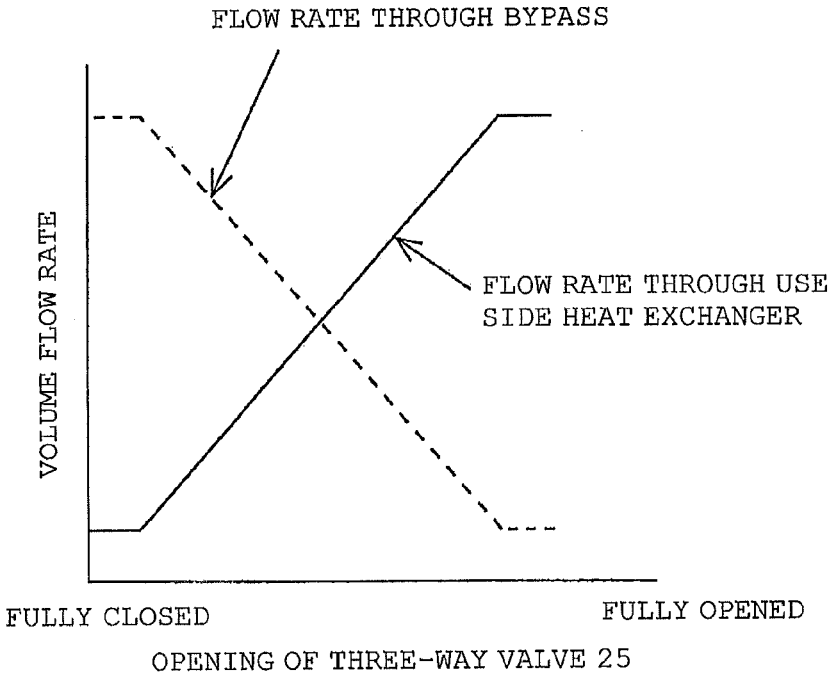
FIG. 6 is a diagram illustrating the characteristic of each of the three-way valves 25*a* to 25*d* according to Embodiment 1 of the present invention.

When determining in step S109 that another indoor unit 2 (use side heat exchanger 26) is in the heating operation, the procedure goes to step S111 to adjust the opening-degree of the three-way valve 25*b* to L1. A method of determining the opening-degree L1 of the three-way valve 25*b* will be described later. Here, an exemplary flow rate characteristic of each of the three-way valves 25*a* to 25*d* is illustrated in FIG. 6. In this example, when each of the three-way valves 25*a* to 25*d* is fully closed, the flow rate through the corresponding one of the bypasses 27*a* to 27*d* is the largest. When each of the three-way valves 25*a* to 25*d* is fully opened, the flow rate through the corresponding one of the use side heat exchangers 26*a* to 26*d* is the largest. After that, in step S112 the stop valve 24*b* is opened (S112).

At the completion of step S112, it is determined whether a temperature tm detected by the temperature sensor 39*b* is above a threshold value α (step S113). In this case, the threshold value α corresponds to a first threshold value. When the detected temperature tm of the temperature sensor 39*b* is at or below the threshold value α, the procedure goes to step S114. The opening-degree of the three-way valve 25*b* is changed from L1 to L1−ΔL to reduce the flow rate of the heat medium flowing into the use side heat exchanger 26*b*. After that, the procedure returns to step S113 again. When the detected temperature tm of the temperature sensor 39*b* is above the threshold value α, the controller 50 proceeds to step S115.

In step S115, it is determined whether a temperature tout detected by the temperature sensor 34*b* (a temperature of the heat medium on the outlet side of the use side heat exchanger 26*b*) is above the threshold value α. Incidentally, a method of determining the threshold value α will be described later. When the detected temperature tout of the temperature sensor 34*b* is at or below the threshold value α, the procedure goes to step S116. In step S116, when determining that the detected temperature tm of the temperature sensor 39*b* is above an upper limit α+ϵ, the procedure goes to step S117 to reduce the flow rate of the heat medium flowing through the bypass 27*b*. At this time, the opening-degree of the three-way valve 25*b* is changed from L1 to L1+ΔL. After that, the procedure returns to step S113 again. Whereas, when determining that tm is at or below α+ϵ, L1 is not changed. Here, α+ϵ is a tolerance of the target value of tm. When the detected temperature tout of the temperature sensor 34*b* is above the threshold value α, it is determined that the low-temperature heat medium stayed in the use side heat exchanger 26*b* and the heat medium pipe 5 connected to the use side heat exchanger 26*b* has been replaced by the high-temperature heat medium and the procedure goes to step S118. At this time, the procedure shifts to control for adjusting an air conditioning load on the use side heat exchanger 26*b* using the three-way valve 25*b*.

On the other hand, when determining in step S109 that another indoor unit 2 (use side heat exchanger 26) is not in the heating operation, the controller 50 opens the stop valve 24*b* (S110) and then shifts to the control for adjusting the air conditioning load on the use side heat exchanger 26*b* using the three-way valve 25*b* (step S118).

(Opening-Degree L1 and Threshold Value α)

The threshold value α and the opening-degree L1 of the three-way valve 25*b* will be described.

The threshold value α and the opening-degree L1 of the three-way valve 25*b* are determined in consideration of an air output temperature of the indoor unit 2*a* (use side heat exchanger 26*a*) in the heating operation.

Before the indoor unit 2*b* is switched to the heating operation, the heat medium exchanges heat with the air of the air-conditioning target space in the use side heat exchanger 26*a*, so that the heat medium is cooled, for example, from 45 degrees C. to 40 degrees C. Furthermore, in the use side heat exchanger 26*a*, the heat medium exchanges heat with the air in the air-conditioning target space, so that the air in the air-conditioning target space is heated, for example, from 20 degrees C. to 40 degrees C. In the intermediate heat exchanger 15*a*, the heat medium is heated, for example, from 40 degrees C. to 45 degrees C. Incidentally, it is assumed that the flow rate of the heat medium passing through the bypass 27*a* is 0 L/min and the flow rate of the heat medium flowing into each of the use side heat exchanger 26*a* and the intermediate heat exchanger 15*a* is 20 L/min.

When the stop valve 24*b* is opened (step S112 in FIG. 7) and the low-temperature heat medium staying in the use side heat exchanger 26*b* and the heat medium pipe 5 connected to the use side heat exchanger 26*b* passes through the three-way valve 23*b*, a temperature Twab of the heat medium at the inlet of the intermediate heat exchanger 15*a* and a flow rate Vw of the heat medium flowing into the use side heat exchanger 26*a* change as follows. Note that it is assumed that the flow rate of the heat medium passing through the three-way valve 22*a* is the same as that through the three-way valve 22*b*.

The heat medium passing through the three-way valve 22*a* exchanges heat with the air in the use side heat exchanger 26*a*, so that it is cooled from 45 degrees C. to 40 degrees C. Whereas, part of the heat medium passing through the three-way valve 22*b* flows toward the use side heat exchanger 26*b* and pushes the cool heat medium staying in the use side heat exchanger 26*b* and the heat medium pipe 5 connected to the use side heat exchanger 26*b*. The other part thereof passes through the bypass 27*b* and mixes with the above-described cool heat medium in the three-way valve 25*b*.

At this time, when Vwr denotes the flow rate of the heat medium flowing into the use side heat exchanger 26*b* and Vwb denotes the flow rate of the heat medium flowing through the bypass 27*b*, a bypass rate Rb is given by Equation (2).

$$Rb=Vwb/(Vwb+Vwr)=Vwb/Vw \quad (2)$$

Using Equation (2), the temperature tm of the heat medium (the heat medium passed through the three-way valve 25*h*) as a mixture of the cool heat medium stayed in the use side heat exchanger 26*b* and the heat medium pipe 5 connected to the use side heat exchanger 26*b* and the high-temperature heat medium passed through the bypass 27*b* is given by the following equation (3):

$$tm=Rb\cdot tb+(1-Rb)twr \quad (3)$$

where twr denotes the temperature of the cool heat medium stayed in the use side heat exchanger 26*b* and the heat medium pipe 5 connected to the use side heat exchanger 26*b* and tb indicates the temperature of the high-temperature heat medium passed through the bypass 27*b*. Further, the temperature tm of the heat medium passed through the three-way valve 25*b* is the same as the temperature twb (the temperature of the heat medium passed through the three-way valve 23*b*) expressed as Equation (1).

For example, assuming that the bypass rate Rb is 0.1, twr is 10 degrees C., and tb is 45 degrees C., the temperature tm of the heat medium passed through the three-way valve 25*b* is 13.5 degrees C.

Further, assuming that the flow rate of the heat medium passing through the three-way valve 23*a* is the same as that of the heat medium passing through the three-way valve 23*b* and a temperature twa of the heat medium passing through the three-way valve 23*a* is 40 degrees C., the temperature of the heat medium as a mixture of the heat medium passed through the three-way valve 23*b* and the heat medium passed through the three-way valve 23*a*, namely, the temperature twab of the heat medium at the inlet of the intermediate heat exchanger 15*a* is 26.8 degrees C. by Equation (1).

In this case, by controlling the rotation speed of the pump 21*a*, the temperature of the heat medium at the outlet of the intermediate heat exchanger 15*a* is controlled at a constant value, e.g., 45 degrees C. When Vwab denotes the flow rate of the heat medium, cpw denotes the specific heat at constant pressure of the heat medium, twhin denotes the temperature of the heat medium at the inlet, and twhout denotes the temperature thereof at the outlet, the amount of heat exchange Qwh in the intermediate heat exchanger 15*a* is given by the following equation (4).

$$Qwh=cpw\cdot Vwab\cdot(twh\text{out}-twh\text{in}) \quad (4)$$

As described above, Qwh is determined in accordance with the number of use side heat exchangers 26 in the heating operation. Specifically, Qwh is determined so that assuming that twhout-twhin is maintained constant at about 5 degrees C., when only the use side heat exchanger 26*a* in the heating operation, Vwab=20 L/min, and when the two use side heat exchangers 26*a* and 26*b* are in the heating operation, Vwab=40 L/min.

When the stop valve 24*b* is opened (step S112 in FIG. 7), the amount of heat exchange Qwh in the intermediate heat exchanger 15*a* increases as described above. At this time, the heat medium inlet temperature twhin lowers from 40 degrees C. to 26.8 degrees C. When the heat medium outlet temperature twhout is maintained constant at 45 degrees C., the heat medium flow rate Vwab changes from 40 L/min to 11 L/min on the basis of Equation (4). In other words, the flow rate Vw of the heat medium flowing into the use side heat exchanger 26*a* is about 5.5 L/min.

Here, the heating capacity qh of the use side heat exchanger 26*a* is given by the following equation (5):

$$qh=cpa\cdot Va\cdot(ta\text{out}-ta\text{in}) \quad (5)$$

where cpa indicates the specific heat at constant pressure of the air, Va denotes the air quantity of the fan, tain indicates the temperature of air flowing into the use side heat exchanger 26*a*, and taout denotes the air output temperature (the temperature of the air blown out of the use side heat exchanger 26*a*).

Assuming that the heating capacity qh is proportional to the heat medium flow rate, the heat medium flowing into the use side heat exchanger 26*a* changes from 20 L/min to 5.5 L/min, so that the air output temperature lowers from 40 degrees C. to about 25.5 degrees C.

Figure 8:
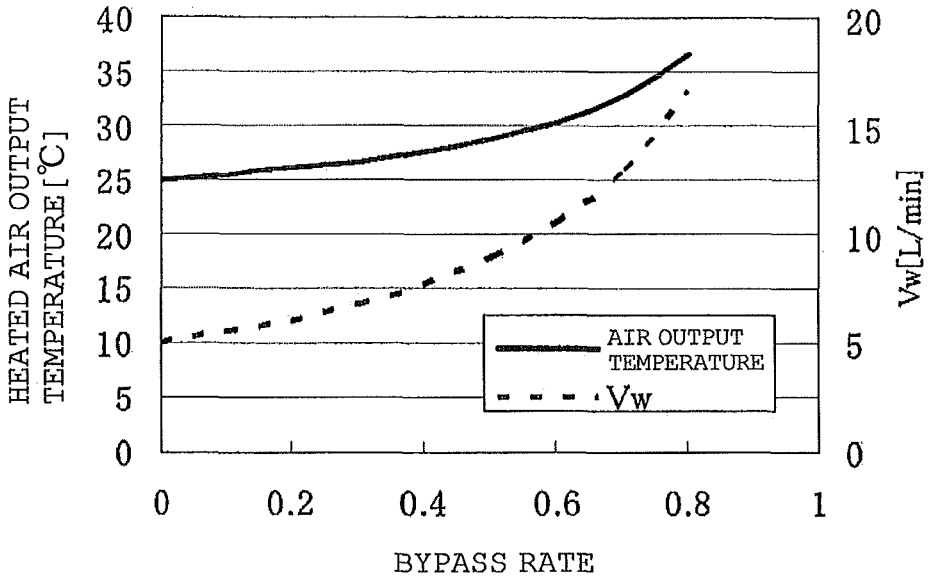
FIG. 8 is a characteristic diagram illustrating the relationship among the bypass rate of a use side heat exchanger 26 switched to the heating operation according to Embodiment 1 of the present invention, the heated air output temperature of the use side heat exchanger 26 in the operation, and the heat medium flow rate thereof.

FIG. 8 illustrates the relationship between the bypass rate of the use side heat exchanger 26*b* and the air output temperature of the indoor unit 2*a* (use side heat exchanger 26*a*) when the indoor unit 2*b* (use side heat exchanger 26*b*) switches from the cooling operation to the heating operation. This relationship of FIG. 8 is obtained by the above-described Equations (1) to (5). FIG. 8 demonstrates that the heated air output temperature of the indoor unit 2*a* (use side heat exchanger 26*a*) rises with increase of the bypass rate Rb of the use side heat exchanger 26*b*. The reason is that as the flow rate of the heat medium passing through the bypass 27*b* is higher, the heat medium temperature at the inlet of the intermediate heat exchanger 15*a* is higher, thus increasing the heat medium flow rate of the use side heat exchanger 26*a*.

Figure 9:
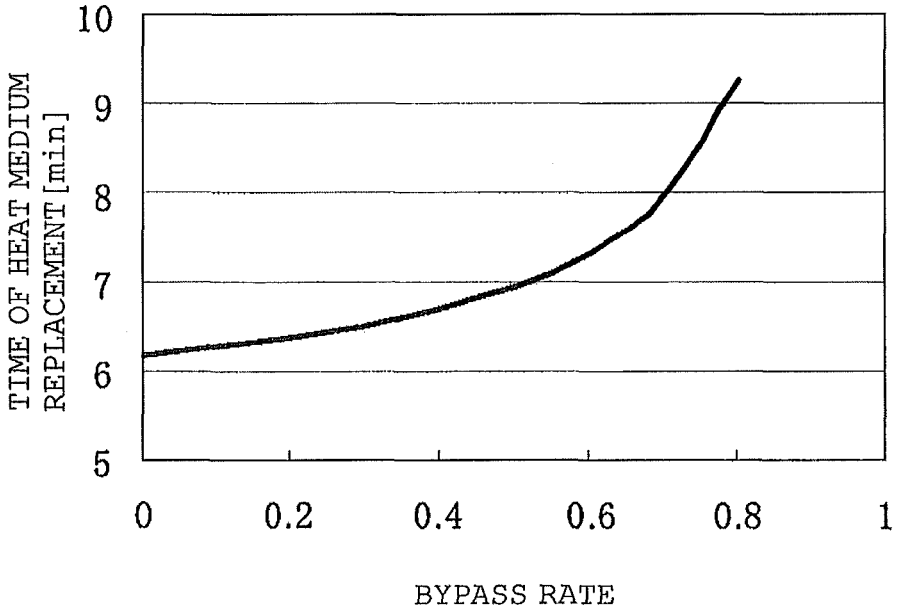
FIG. 9 is a characteristic diagram illustrating the relationship between the bypass rate of the use side heat exchanger 26 switched to the heating operation according to Embodiment 1 and the time of replacement of the heat medium staying in a pipe and the use side heat exchanger 26.

FIG. 9 illustrates the relationship between the bypass rate of the use side heat exchanger 26*b* and replacement time of the low-temperature heat medium in the heat medium pipe 6 connected to the use side heat exchanger 26*b* when the indoor unit 2*b* (use side heat exchanger 26*b*) switches from the stop state or the cooling operation to the heating operation. The time Tc during which the low-temperature heat medium in the heat medium pipe 5 is replaced by the high-temperature heat medium is given by the following equation (6):

$$Tc=M/(Vw\cdot Rb) \tag{6}$$

where M denotes the volume of the heat medium staying in the heat medium pipe 5 and Vw indicates the flow rate at the outlet of the three-way valve 25*b*. Note that Equation (6) is based on the assumption that the air-conditioning apparatus, such as a multi-unit air conditioner for buildings, has long heat medium pipes 5. In some multi-unit air conditioners for buildings, the length of a single heat medium pipe 5 is about 50 m. For example, assuming that the inner diameter of the heat medium pipe 5 is 20 mm, the volume M of the heat medium staying in the heat medium pipe 5 is about 31 L. Since the volume of the heat medium in the use side heat exchanger 26 is smaller than the above, only the heat medium pipe 5 is taken into consideration here.

Referring to FIG. 9, the time Tc during which the low-temperature heat medium in the heat medium pipe 5 is replaced by the high-temperature heat medium increases with increase of the bypass rate Rb of the use side heat exchanger 26*b*. This demonstrates that as the bypass rate Rb of the use side heat exchanger 26*b* increases, the flow rate of the heat medium flowing into the use side heat exchanger 26*b* decreases, thus increasing the time Tc during which the cool heat medium is replaced by the hot heat medium. As described above, when the bypass rate Rb of the use side heat exchanger 26*b* is increased, the heated air output temperature of the indoor unit 2*a* (use side heat exchanger 26*a*) can be raised. On the contrary, the time Tc for heat medium replacement increases. Disadvantageously, it takes long time until hot air is blown from the indoor unit 2*b* (use side heat exchanger 26*b*).

In Embodiment 1, therefore, the bypass rate Rb is determined so that the heating capacity qh of the use side heat exchanger 26*a* after switching the indoor unit 2*b* (use side heat exchanger 26*b*) to the heating operation can be maintained at 50% of the heating capacity qh of the use side heat exchanger 26*a* before switching the indoor unit 2*b* (use side heat exchanger 26*b*) to the heating operation. In other words, the bypass rate Rb is determined so that the heating capacity qh of the use side heat exchanger 26*a* when the heat medium flow rate of the use side heat exchanger 26*a* is 5.5 L/min can be maintained at 50% of the heating capacity qh of the use side heat exchanger 26*a* when the heat medium flow rate of the use side heat exchanger 26*a* is 20 L/min. The threshold value α and the opening-degree L1 of the three-way valve 25*b* are determined on the basis of this bypass rate Rb and FIG. 8.

Specifically, in order to maintain the heating capacity qh of the use side heat exchanger 26*a* after switching the indoor unit 2*b* (use side heat exchanger 26*b*) to the heating operation at 50% of the heating capacity qh of the use side heat exchanger 26*a* before switching the indoor unit 2*b* (use side heat exchanger 26*b*) to the heating operation, assuming that the air quantity Va of the fan in the indoor unit 2*a* is constant and the temperature tain of the air flowing into the use side heat exchanger 26*a* is 20 degrees C., it is obvious from Equation (5) that the heated air output temperature taout of the indoor unit 2*a* should be at or above 30 degrees C. Further, in order to maintain the heated air output temperature taout of the indoor unit 2*a*, it is obvious from FIG. 8 that the bypass rate Rb of the use side heat exchanger 26*b* should be set to 0.6. In order to set the bypass rate Rb of the use side heat exchanger 26*b* to 0.6, it is obvious from Equation (3) that the temperature tm of the heat medium passed through the three-way valve 25*b* (the temperature detected by the temperature sensor 39*b*) should be 31 degrees C. Therefore, this tm serves as the threshold value α. Note that the opening-degree of the three-way valve 25*b* when the bypass rate Rb of the use side heat exchanger 26*b* is 0.6 is L1.

(Conditions for Restarting Fan)

Subsequently, the conditions for restarting the fan in the indoor unit 2*b* after switching the indoor unit 2*b* to the heating operation will be described.

When the bypass rate Rb of the use side heat exchanger 26*b* is 0.6 as described above, the time Tc of replacement of the heat medium in the heat medium pipe 5 connected to the use side heat exchanger 26*b* is about 7.4 minutes. Since the heat medium pipe 5 toward the use side heat exchanger 26*b* has the same length as that returning from the use side heat exchanger 26*b*, the time required until the hot heat medium reaches the use side heat exchanger 26*b* is about 3.7 minutes. Accordingly, T1 illustrated in step S107 in FIG. 7 can be set to 3.7 minutes. However, this T1 is a maximum value of the time required until the hot heat medium reaches the use side heat exchanger 26*b*. In addition, if the temperature tout of the heat medium at the outlet of the use side heat exchanger 26*b* is above the threshold value α, the replacement of the heat medium in the use side heat exchanger 26*b* can be determined (S115 in FIG. 7). Therefore, the condition as to whether tout>α is determined in addition to the condition for restarting the fan in the indoor unit 2*b*, thus preventing useless delay of start of the fan.

Next, the effect suppression method will be described with respect to a case where operation modes are changed from a state in which the indoor unit 2*b* is in the cooling operation and the indoor unit 2*a* is in the stop state or the heating operation (the state illustrated in FIG. 5) to a state where the indoor units 2*a* and 2*b* are in the cooling operation (the state illustrated in FIG. 3). In other words, the effect suppression method in the case where the operation mode of the indoor unit 2*a* is switched from the stop state to the cooling operation, alternatively, from the heating operation to the cooling operation will be described.

Figure 10:
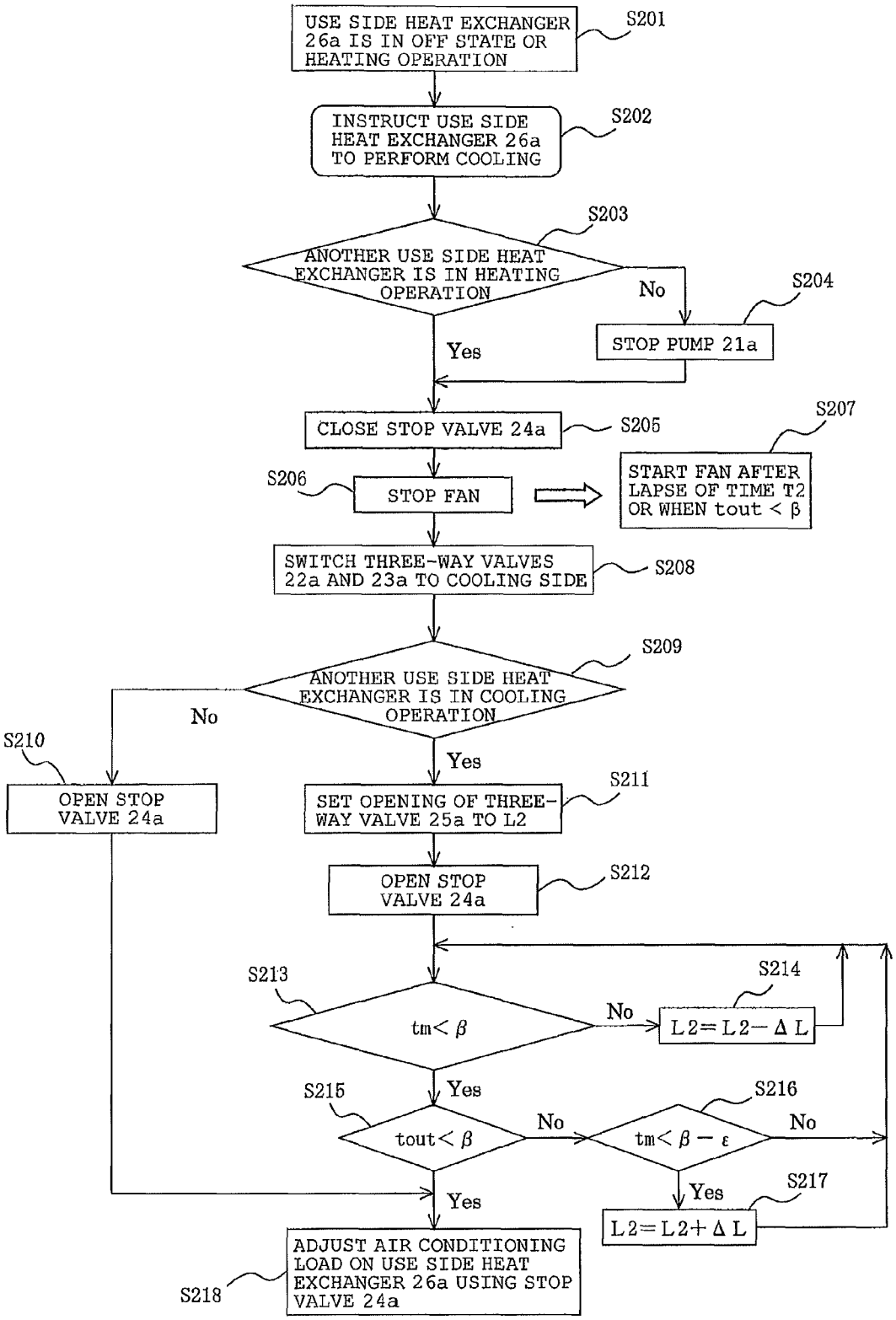
FIG. 10 is a flowchart illustrating an effect suppression method according to Embodiment 1 of the present invention.

FIG. 10 is a flowchart illustrating the effect suppression method according to Embodiment 1 of the present invention.

When the indoor unit 2*a* (use side heat exchanger 26*a*) in the stop state or the heating operation (step S201) is switched to the cooling operation (step S202), the controller 50 determines whether another indoor unit 2 (use side heat exchanger 26) is in the heating operation (step S203). If another indoor unit 2 (use side heat exchanger 26) is not in the heating operation, the procedure goes to step S204 to stop the pump 21*a* and then goes to step S205. If another indoor unit 2 (use side heat exchanger 26) is in the heating operation, the procedure goes to step S205 to close the stop valve 24*a*. Then, the procedure goes to step S206 to stop the fan (not illustrated) in the indoor unit 2*a*. Incidentally, conditions for again starting the fan (S207) will be described later. In step S208, the three-way valves 22*a* and 23*a* are switched to the cooling side (the flow path connected to the intermediate heat exchanger 15*b*). In step S209, it is determined whether another indoor unit 2 (use side heat exchanger 26) is in the cooling operation.

When determining in step S209 that another indoor unit 2 (use side heat exchanger 26) is in the cooling operation, the procedure goes to step S211 to adjust the opening-degree of the three-way valve 25*a* to L2. Incidentally, a method of determining the opening-degree L2 of the three-way valve 25*a* will be described later. After that, in step S212, the stop valve 24*a* is opened (S212).

At the completion of step S212, it is determined whether the temperature tm detected by the temperature sensor 39*a* is below a threshold value β (step S213). Here, the threshold value β corresponds to a second threshold value. When the detected temperature tm of the temperature sensor 39*a* is at or above the threshold value β, the procedure goes to step S214. Then, the opening-degree of the three-way valve 25*a* is changed from L2 to L2−ΔL to reduce the flow rate of the heat medium flowing into the use side heat exchanger 26*a*. After that, the procedure returns to step S213 again. When the detected temperature tm of the temperature sensor 39*a* is below the threshold value β, the procedure goes to step S215.

In step S215, it is determined whether the detected temperature tout of the temperature sensor 34*a* (the heat medium temperature on the outlet side of the use side heat exchanger 26*a*) is below the threshold value β. Incidentally, a method of determining the threshold value β will be described later. When the detected temperature tout of the temperature sensor 34*a* is at or above the threshold value β, the procedure goes to step S216. When determining in step S216 that the detected temperature tm of the temperature sensor 39*a* is below an upper limit β−ϵ, the procedure goes to step S217 to reduce the flow rate of the heat medium flowing through the bypass 27*a*. Then, the opening-degree of the heat medium flow rate adjusting valve is changed from L2 to L2+ΔL. After that, the procedure returns to step S213 again. On the other hand, when tm is at or above β−ϵ, L2 is not changed. Here, β−ϵ is a tolerance of the target value of tm. When the detected temperature tout of the temperature sensor 34*a* is below the threshold value β, it is determined the replacement of the high-temperature heat medium stayed in the use side heat exchanger 26*a* and the heat medium pipe 5 connected to the use side heat exchanger 26*a* with the low-temperature heat medium, then procedure goes to step S218. At this time, procedure shifts to control for adjusting an air conditioning load on the use side heat exchanger 26*a* using the three-way valve 25*a*.

Whereas, when determining in step S209 that another indoor unit 2 (use side heat exchanger 26) is not in the cooling operation, the stop valve 24*a* is opened (S210) and procedure shifts to the control for adjusting the air conditioning load on the use side heat exchanger 26*b* using the three-way valve 25*a* (step S218).

(Opening-Degree L2 and Threshold Value β)

The threshold value β and the opening-degree L2 of the three-way valve 25*b* will be described.

The threshold value β and the opening-degree L2 of the three-way valve 25*b* are determined in consideration of the air output temperature of the indoor unit 2*b* (use side heat exchanger 26*b*) in the cooling operation.

Before the indoor unit 2*a* is switched to the heating operation, the heat medium exchanges heat with the air in the air-conditioning target space in the use side heat exchanger 26*b*, so that the heat medium is heated, for example, from 7 degrees C. to 13 degrees C. Further, in the use side heat exchanger 26*b*, the heat medium exchanges heat with the air in the air-conditioning target space, so that the air in the air-conditioning target space is cooled from 27 degrees C. to 12 degrees C., for example. In the intermediate heat exchanger 15*b*, for example, the heat medium is cooled from 13 degrees C. to 7 degrees C. Note that it is assumed that the flow rate of the heat medium passing through the bypass 27*b* is 0 L/min and the flow rate of the heat medium flowing into each of the use side heat exchanger 26*b* and the intermediate heat exchanger 15*b* is 20 L/min.

When the stop valve 24*a* is opened (step S212 in FIG. 10) and the high-temperature heat medium staying in the use side heat exchanger 26*a* and the heat medium pipe 5 connected to the use side heat exchanger 26*a* passes through the three-way valve 23*a*, the temperature Twab of the heat medium at the inlet of the intermediate heat exchanger 15*b* and the flow rate Vw of the heat medium flowing into the use side heat exchanger 26*b* change as follows. Note that it is assumed that the flow rate of the heat medium passing through the three-way valve 22*a* is the same as that of the heat medium passing through the three-way valve 22*b*.

The heat medium passing through the three-way valve 22*b* exchanges heat with the air in the use side heat exchanger 26*b*, so that it is heated from 7 degrees C. to 13 degrees C. Whereas, part of the heat medium passing through the three-way valve 22*a* flows toward the use side heat exchanger 26*a* and pushes the high-temperature heat medium staying in the use side heat exchanger 26*a* and the heat medium pipe 5 connected to the use side heat exchanger 26*a*. Further, the other part thereof passes through the bypass 27*a* and mixes with the above-described high-temperature heat medium in the three-way valve 25*a*. At this time, assuming that the bypass rate Rb is 0.1, the temperature twr of the high-temperature heat medium staying in the use side heat exchanger 26*a* and the heat medium pipe 5 connected to the use side heat exchanger 26*a* is 42.5 degrees C., and the temperature tb of the heat medium passing through the bypass 27*a* is 7 degrees C., the temperature tm of the heat medium passed through the three-way valve 25*a* is 39 degrees C. on the basis of Equation (3).

Further, assuming that the flow rate of the heat medium passing through the three-way valve 23*a* is the same as that of the heat medium passing through the three-way valve 23*b* and the temperature twa of the heat medium passing through the three-way valve 23*b* is 13 degrees C., the temperature of the heat medium as a mixture of the heat medium passed through the three-way valve 23*b* and the heat medium passed through the three-way valve 23*a*, namely, the temperature twab of the heat medium at the inlet of the intermediate heat exchanger 15*b* is about 26 degrees C. on the basis of Equation (1).

In this case, controlling the rotation speed of the pump 21*b* controls the temperature of the heat medium at the outlet of the intermediate heat exchanger 15*b* at a constant value 7 degrees C., for example. When Vwab denotes the flow rate of the heat medium, cpw denotes the specific heat at constant pressure of the heat medium, twcin denotes the temperature of the heat medium at the inlet, and twcout denotes the temperature thereof at the outlet, the amount of heat exchange Qwc in the intermediate heat exchanger 15*b* is given by the following equation (7).

$$Qwc=cpw\cdot Vwab\cdot(twcin-twcout) \quad (7)$$

As described above, Qwc is determined in accordance with the number of use side heat exchangers 26 in the cooling operation. Specifically, Qwc is determined so that assuming that twcin-twcout is maintained constant at about 6 degrees C., when only the use side heat exchanger 26*b* is in the cooling operation, Vwab=20 L/min, and when the two use side heat exchangers 26*a* and 26*b* are in the cooling operation, Vwab=40 L/min.

When the stop valve 24*b* is opened (step S212 in FIG. 10), the amount of heat exchange Qwc in the intermediate heat exchanger 15*b* increases as described above. At this time, the heat medium inlet temperature twcin rises from 13 degrees C. to 26 degrees C. When the heat medium outlet temperature twcout is maintained constant at 7 degrees C., the heat medium flow rate Vwab changes from 40 L/min to 12.6 LL/min on the basis of Equation (7). In other words, the flow rate Vw of the heat medium flowing into the use side heat exchanger 26*b* is about 6.3 L/min.

Here, a cooling capacity qc of the use side heat exchanger 26*b* is given by the following equation (8):

$$qc=cpai\cdot Va\cdot(iain-iaout) \quad (8)$$

where cpai denotes the enthalpy-based specific heat at constant pressure of the air, Va indicates the air quantity of the fan, iain denotes the enthalpy of the air at the inlet of the use side heat exchanger 26*b*, and iaout denotes the enthalpy of the air at the outlet of the use side heat exchanger 26*b*.

Assuming that the cooling capacity qc is proportional to the heat medium flow rate, the heat medium flowing into the use side heat exchanger 26*b* changes from 20 L/min to 6.3 L/min, so that the air output temperature converted from iaout rises from 12 degrees C. to 20.0 degrees C. Note that calculation is made on the assumption that lain is constant.

Figure 11:
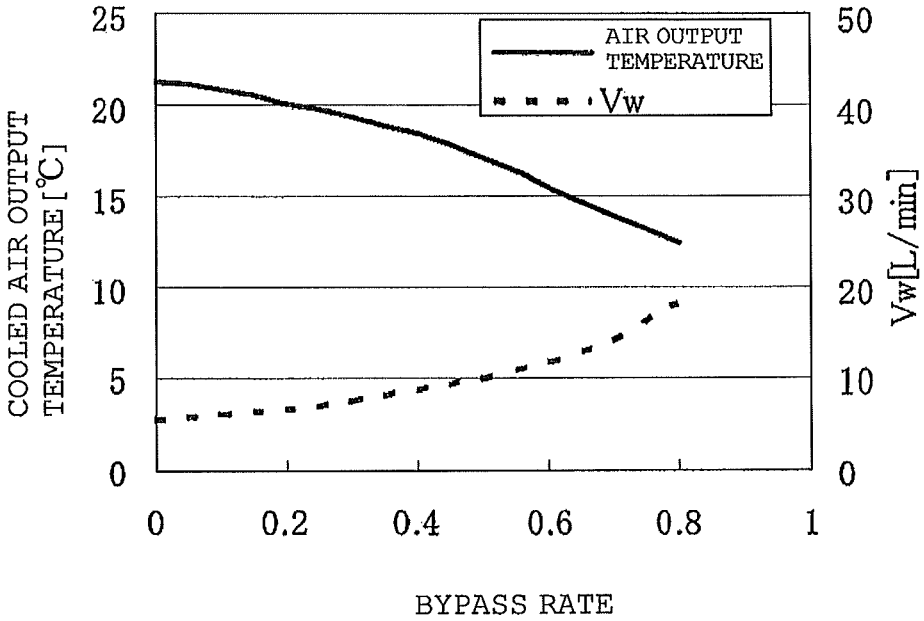
FIG. 11 is a characteristic diagram illustrating the relationship of the cooled air output temperature of the use side heat exchanger 26 in the operation and the heat medium flow rate thereof, against the bypass rate of the use side heat exchanger 26 switched to a cooling operation according to Embodiment 1 of the present invention.

FIG. 11 illustrates the relationship between the bypass rate of the use side heat exchanger 26*a* and the air output temperature of the indoor unit 2*b* (use side heat exchanger 26*b*) when the indoor unit 2*a* (use side heat exchanger 26*a*) is switched from the stop state or the heating operation to the cooling operation. FIG. 11 demonstrates that the cooled air output temperature of the indoor unit 2*b* (use side heat exchanger 26*b*) lowers with increase of the bypass rate Rb of the use side heat exchanger 26*a*. The reason is that as the flow rate of the heat medium passing through the bypass 27*a* is higher, the heat medium temperature at the inlet of the intermediate heat exchanger 16*b* is lower, thus increasing the heat medium flow rate Vw of the use side heat exchanger 26*b*.

Figure 12:
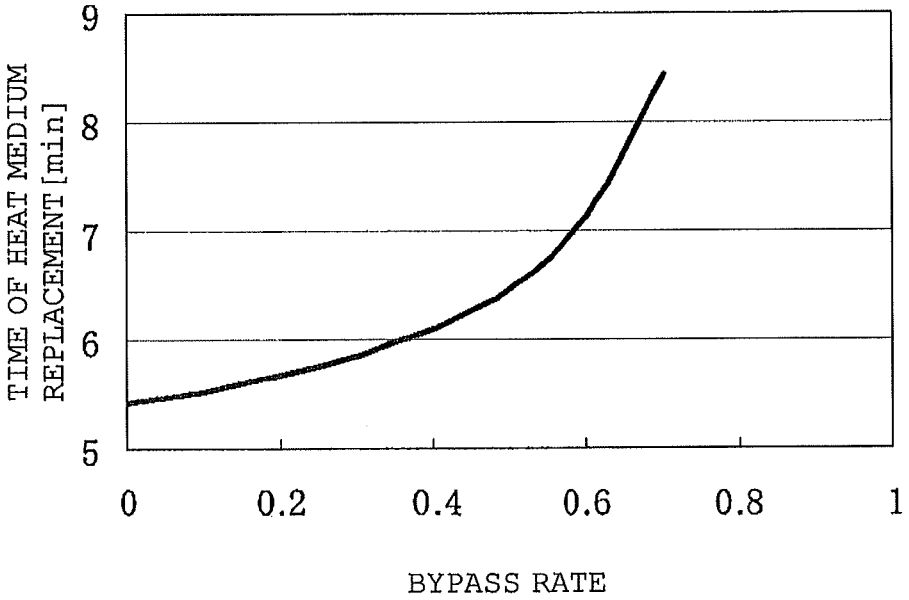
FIG. 12 is a characteristic diagram illustrating the relationship between the time of replacement of the heat medium staying in the pipe and the use side heat exchanger 26 and the bypass rate of the use side heat exchanger 26 switched to the cooling operation according to Embodiment 1 of the present invention.

Further, FIG. 12 illustrates the relationship between the bypass rate of the use side heat exchanger 26*a* and replacement time Tc of the high-temperature heat medium in the heat medium pipe 5 connected to the use side heat exchanger 26*a* when the indoor unit 2*a* (use side heat exchanger 26*a*) is switched from the stop state or the heating operation to the cooling operation. The time Tc during which the high-temperature heat medium in the heat medium pipe 5 is replaced by the low-temperature heat medium is given by Equation (6)

Referring to FIG. 12, the time Tc during which the high-temperature heat medium in the heat medium pipe 5 is replaced by the low-temperature heat medium increases with increase of the bypass rate Rb of the use side heat exchanger 26*a*. This demonstrates that as the bypass rate Rb of the use side heat exchanger 26*a* increases, the flow rate of the heat medium flowing into the use side heat exchanger 26*a* decreases, thus increasing the time Tc during which the high-temperature heat medium is replaced by the low-temperature heat medium. As described above, when the bypass rate Rb of the use side heat exchanger 26*a* is increased, the cooled air output temperature of the indoor unit 2*b* (use side heat exchanger 26*b*) can be lowered. On the contrary, the time Tc for heat medium replacement increases. Disadvantageously, it takes long time until cool air is blown from the indoor unit 2*a* (use side heat exchanger 26*a*).

In Embodiment 1, therefore, the bypass rate Rb is determined so that the cooling capacity qc of the use side heat exchanger 26*b* after switching the indoor unit 2*a* (use side heat exchanger 26*a*) to the cooling operation can be maintained at 50% of the cooling capacity qc of the use side heat exchanger 26*b* before switching the indoor unit 2*a* (use side heat exchanger 26*a*) to the cooling operation. In other words, the bypass rate Rb is determined so that the cooling capacity qc of the use side heat exchanger 26*b* when the heat medium flow rate of the use side heat exchanger 26*b* is 6.3 L/min can be maintained at 50% of the cooling capacity qc of the use side heat exchanger 26*b* when the heat medium flow rate of the use side heat exchanger 26*b* is 20 L/min. The threshold value β and the opening-degree L2 of the three-way valve 25*a* are determined on the basis of this bypass rate Rb and FIG. 11.

Figure 13:
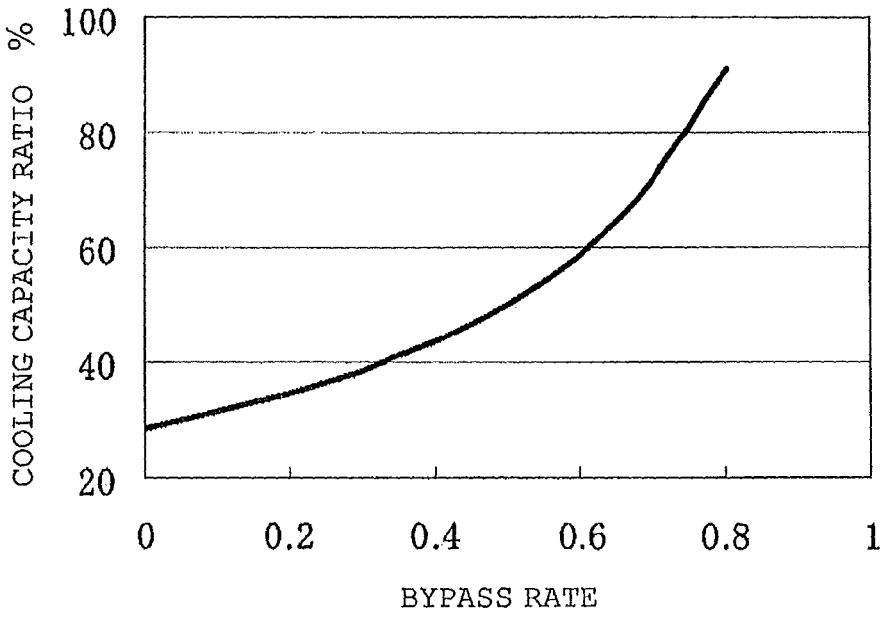
FIG. 13 is a characteristic diagram illustrating the relationship between the cooling capacity ratio of the use side heat exchanger 26 in the cooling operation and the bypass rate of the use side heat exchanger 26 switched to the cooling operation according to Embodiment 1 of the present invention.

FIG. 13 is a characteristic diagram illustrating the relationship between the bypass rate of the use side heat exchanger 26 to be switched to the cooling operation and the cooling capacity ratio of the use side heat exchanger 26 in the cooling operation according to Embodiment 1 of the present invention. In FIG. 13, the axis of ordinate denotes the ratio of the cooling capacity qc of the use side heat exchanger 26*b* after switching the indoor unit 2*a* (use side heat exchanger 26*a*) to the cooling operation to the cooling capacity qc of the use side heat exchanger 26*h* before switching the indoor unit 2*a* (use side heat exchanger 26*a*). FIG. 13 demonstrates that the bypass rate Rb of the use side heat exchanger 26*a* should be 0.5 in order to maintain the cooling capacity qc of the use side heat exchanger 26*b* after switching the indoor unit 2*a* (use side heat exchanger 26*a*) to the cooling operation at 50% of the cooling capacity qc of the use side heat exchanger 26*b* before switching the indoor unit 2*a* (use side heat exchanger 26*a*) to the cooling operation. The cooled air output temperature at this time is 17.3 degrees C. on the basis of FIG. 11. Further, referring to FIG. 12, the time of heat medium replacement is about 6.1 minutes. In order to set the bypass rate Rb of the use side heat exchanger 26*a* to 0.5, it is obvious from Equation (3) that the temperature tm of the heat medium passed through the three-way valve 25*a* (the temperature detected by the temperature sensor 39*a*) should be 18.9 degrees C. Therefore, this tm serves as the threshold value β. Note that the opening-degree of the three-way valve 25*a* when the bypass rate Rb of the use side heat exchanger 26*a* is 0.5 is L2.

(Conditions for Restarting Fan)

Subsequently, the conditions for restarting the fan in the indoor unit 2*a* after switching the indoor unit 2*a* to the cooling operation will be described.

When the bypass rate Rb of the use side heat exchanger 26*a* is 0.5 as described above, the time Tc of replacement of the heat medium in the heat medium pipe 5 connected to the use side heat exchanger 26*a* is about 6.1 minutes. Since the heat medium pipe 5 toward the use side heat exchanger 26*a* has the same length as that returning from the use side heat exchanger 26*a*, the time required until the low-temperature heat medium reaches the use side heat exchanger 26*a* is about 3.1 minutes.

Accordingly, T2 illustrated in step S207 in FIG. 10 can be set to 3.1 minutes. However, this T2 is a maximum value of the time required until the low-temperature heat medium reaches the use side heat exchanger 26*a*. In addition, if the temperature tout of the heat medium at the outlet of the use side heat exchanger 26*a* is below the threshold value β, the replacement of the heat medium in the use side heat exchanger 26*a* can be determined (S215 in FIG. 10). Therefore, the condition as to whether tout<β is determined in addition to the condition for restarting the fan in the indoor unit 2*a*, thus preventing useless delay of start of the fan.

In the air-conditioning apparatus configured as described above, when the operation mode of the use side heat exchanger 26 is changed, the flow rate of the heat medium flowing into this use side heat exchanger 26 in the changed operation mode is adjusted. Accordingly, the air-conditioning apparatus can be provided such that the cooling and heating operations can be simultaneously performed while a change in air output temperature of another use side heat exchanger 26 is suppressed. For example, when operation modes are changed from a state where the indoor unit 2*a* is in the heating operation and the indoor unit 2*b* is in the stop state or the cooling operation (the state illustrated in FIG. 5) to a state where the indoor units 2*a* and 2*b* are in the heating operation (the state illustrated in FIG. 3), the bypass rate Rb of the use side heat exchanger 26*b* is set to 0.6, so that the heated air output temperature in the indoor unit 2*a* can be at 30 degrees C. Therefore, a reduction in heated air output temperature in the indoor unit 2*a* caused by mixing of the heat media can be suppressed. Further, for example, when operation modes are changed from a state where the indoor unit 2*b* is in the cooling operation and the indoor unit 2*a* is in the stop state or the heating operation (the state illustrated in FIG. 5) to a state where the indoor units 2*a* and 2*b* are in the cooling operation (the state illustrated in FIG. 3), the bypass rate Rb of the use side heat exchanger 26*a* is set to 0.5, so that the cooled air output temperature in the indoor unit 2*b* can be at 17.3 degrees C. Therefore, an increase in cooled air output temperature in the indoor unit 2*b* caused by mixing of the heat media can be suppressed.

Moreover, assuming that the operation mode of the use side heat exchanger 26 is switched to another mode, if there is no use side heat exchanger 26 which has been performing in the other mode, the above-described control is not performed. Therefore, useless delay until the fan in the indoor unit 2 switched to the other operation mode is restarted can be prevented.

Further, the heat source unit 1 is a heat pump heat source unit including the refrigeration cycle circuit. In the air-conditioning apparatus performing the above-described control on the heat medium circulation circuit in Embodiment 1, since a change in temperature of the heat medium flowing into each of the intermediate heat exchangers 15*a* and 15*b* is small, the refrigeration cycle circuit (heat source unit 1) can be stably operated.

Moreover, in Embodiment 1, the heat medium inlet of each use side heat exchanger 26 can be connected to the three-way valve 22 through a single heat medium pipe 5. The heat medium outlet of each use side heat exchanger 26 can be connected to the three-way valve 23 through a single heat medium pipe 5. Therefore, for example, the three-way valve 22 and the three-way valve 23 are provided for the relay unit 3, so that the relay unit 3 can be connected to each use side heat exchanger 26 through a single heat medium path.

The bypass rate Rb described in Embodiment 1 is just an example and may be arbitrarily changed in accordance with operating conditions of each indoor unit 2 (use side heat exchanger 26).

For example, when the operation mode of the use side heat exchanger 26*b* is switched from the stop state or the cooling operation to the heating operation and at least two of the other use side heat exchangers 26*a*, 26*c*, and 26*d* are in the heating operation, the heat capacity of the heat medium for the heating operation is large. Accordingly, a reduction in temperature of the heat medium flowing into the intermediate heat exchanger 15*a* becomes smaller. Therefore, this results in an increase in the flow rate Vw of the heat medium flowing through the use side heat exchangers 26 which have been in the heating operation before the operation mode of the use side heat exchanger 26*b* is changed, thus increasing the heated air output temperature. Consequently, the bypass rate Rb of the use side heat exchanger 26*b* (the time Tc of replacement of the heat medium staying in the use side heat exchanger 26*b* and the heat medium pipe 5 connected to the use side heat exchanger 26*h*) can be reduced.

Further, for example, when the operation mode of the use side heat exchanger 26*a* is switched from the stop state or the heating operation to the cooling operation and at least two of the other use side heat exchangers 26*b* to 26*d* are in the cooling operation, the heat capacity of the heat medium for the cooling operation is large. Accordingly, an increase in temperature of the heat medium flowing into the intermediate heat exchanger 15*a* becomes smaller. This results in an increase in the flow rate Vw of the heat medium flowing into the use side heat exchangers 26 which have been in the cooling operation before the operation mode of the use side heat exchanger 26*a* is changed, thus lowering the cooled air output temperature. Consequently, the bypass rate Rb of the use side heat exchanger 26*a* (the time Tc of replacement of the heat medium staying in the use side heat exchanger 26*a* and the heat medium pipe 5 connected to the use side heat exchanger 26*a*) can be reduced.

Embodiment 2

In the above-described Embodiment 1, the flow rate of the heat medium flowing to each of the use side heat exchangers 26*a* to 26*d* is adjusted on the basis of a temperature detected by the corresponding one of the temperature sensors 39*a* to 39*d*. The flow rate of the heat medium flowing into each of the use side heat exchangers 26*a* to 26*d* can be adjusted on the basis of a temperature detected by the corresponding one of the temperature sensors 34*a* to 34*d*.

As an example, the effect suppression method when operation modes are changed from a state where the indoor unit 2*a* is in the heating operation and the indoor unit 2*b* is in the stop state or the cooling operation (the state illustrated in FIG. 5) to a state where the indoor units 2*a* to 2*b* are in the heating operation (the state illustrated in FIG. 3) will be described. In other words, the effect suppression method in the case where the operation mode of the indoor unit 2*b* is switched from the stop state or the cooling operation to the heating operation will be described.

Figure 14:
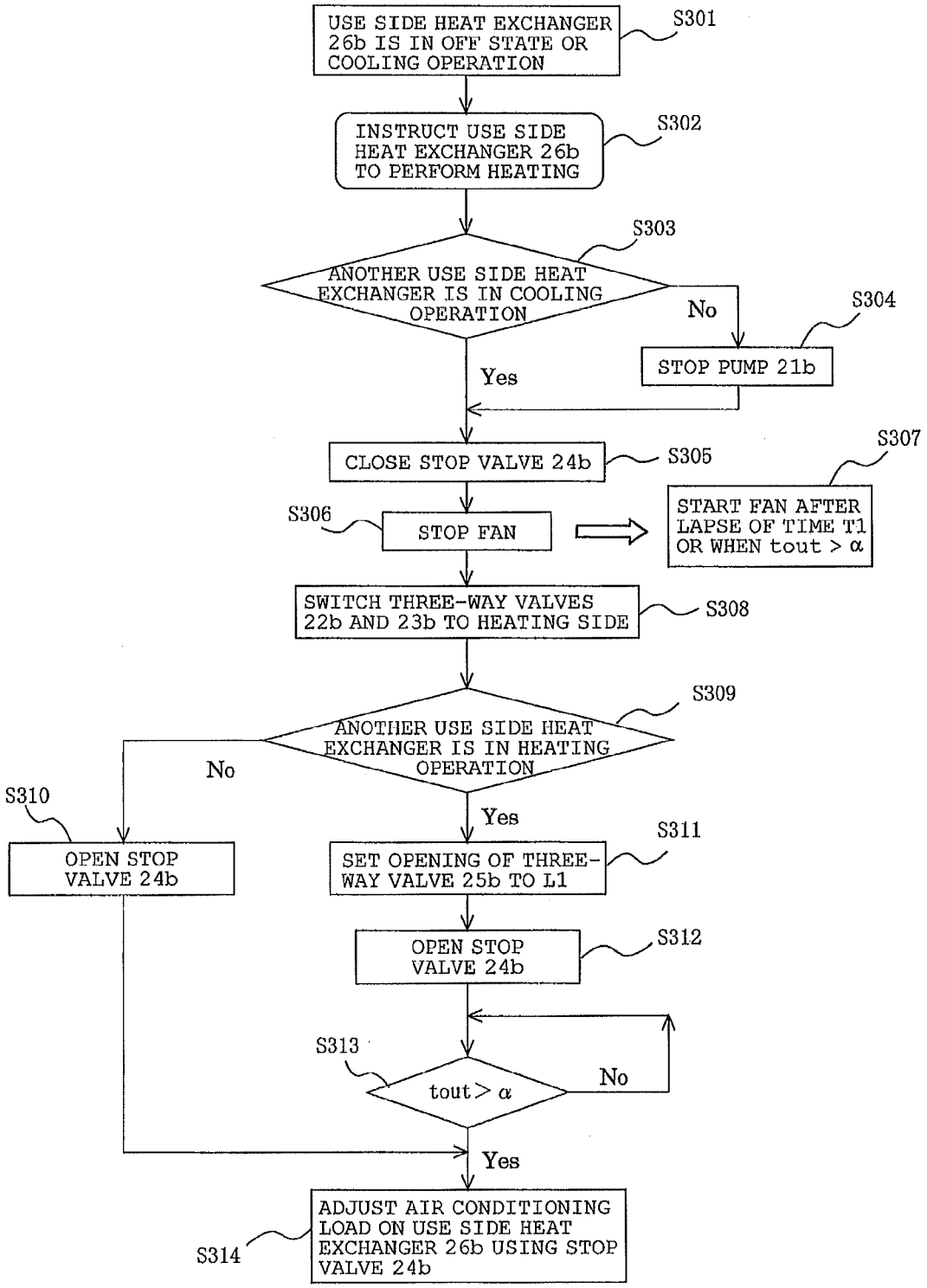
FIG. 14 is a flowchart illustrating an effect suppression method according to Embodiment 2 of the present invention.

FIG. 14 is a flowchart illustrating the effect suppression method according to Embodiment 2 of the present invention. When the indoor unit 2*b* (use side heat exchanger 26*b*), which is in the stop state or in the cooling operation (step S301), is switched to the heating operation (step S302), the controller 50 determines whether another indoor unit 2 (use side heat exchanger 26) is in the cooling operation (step S303). If another indoor unit 2 (use side heat exchanger 26) is not in the cooling operation, the procedure goes to step S304 to stop the pump 21*b* and then goes to step S305. If another indoor unit 2 (use side heat exchanger 26) is in the cooling operation, the procedure goes to step S305 to close the stop valve 24*b*. Then, the procedure goes to step S306 to stop the fan (not illustrated) in the indoor unit 2*b*. Conditions for again starting the fan (S307) are as described above. In step S308, the three-way valves 22*b* and 23*b* are switched to the heating side (the flow path connected to the intermediate heat exchanger 15*a*). In step S309, it is determined whether another indoor unit 2 (use side heat exchanger 26) is in the heating operation.

When determining in step S309 that the other indoor unit 2 (use side heat exchanger 26) is in the heating operation, the procedure goes to step S311 to adjust the opening-degree of the three-way valve 25*b* to L1. The opening-degree L1 of the three-way valve 25*b* may be the same as described above. After that, the controller 50 opens the stop valve 24*b* in step S312 (S312).

At the completion of step S312, it is determined whether the temperature tout detected by the temperature sensor 34*b* (the temperature of the heat medium on the outlet side of the use side heat exchanger 26*b*) is above a threshold value α. Incidentally, the threshold value α may be the same as that described above. When the detected temperature tout of the temperature sensor 34*b* is above the threshold value α, it is determined that the low-temperature heat medium stayed in the use side heat exchanger 26*b* and the heat medium pipe 5 connected to the use side heat exchanger 26*b* has been replaced by the high-temperature heat medium and proceeds to step S314. At this time, the procedure shifts to control for adjusting an air conditioning load on the use side heat exchanger 26*b* using the three-way valve 25*b*. When the detected temperature tout of the temperature sensor 34*b* is at or below the threshold value α, the procedure returns to step S313.

On the other hand, when determining in step S309 that another indoor unit 2 (use side heat exchanger 26) is not in the heating operation, the procedure moves to open the stop valve 24*b* (S310) and then shifts to the control for adjusting the air conditioning load on the use side heat exchanger 26*b* using the three-way valve 25*b* (step S314). In step S314, the controller 50 adjusts the opening-degree L1 of the three-way valve 25*b* on the basis of the difference between the temperature on the inlet side of the use side heat exchanger 26*b* and the temperature on the outlet side thereof. In Embodiment 2, the opening-degree L1 of the three-way valve 25*b* is limited to a narrower level in processing of the above-described step S311 in order to prevent a reduction in temperature of the heat medium. Accordingly, when shifting to the normal operation mode in step S314, the controller 50 changes the opening-degree L1 to become larger to supply the necessary amount of heat medium to the use side heat exchanger 26*b*.

Further, when operation modes are changes from a state where the indoor unit 2*a* is in the heating operation and the indoor unit 2*b* is in the stop state or the cooling operation (the state illustrated in FIG. 5) to a state where the indoor units 2*a* and 2*b* are in the heating operation (the state illustrated in FIG. 3), the flow rate of the heat medium flowing into each of the use side heat exchangers 26*a* to 26*d* is adjusted on the basis of the temperature detected by the corresponding one of the temperature sensors 34*a* to 34*d*, so that effects can be suppressed.

Incidentally, in Embodiments 1 and 2, the opening-degree of the three-way valve 25 connected to the indoor unit 2 (use side heat exchanger 26) whose operation state is changed (which is turned on from the stop state, alternatively, whose operation mode is changed) is controlled on the basis of at least one of the temperature of the heat medium flowing out of this three-way valve and the temperature of the heat medium flowing into this three-way valve. Thus, a change in air output temperature in each of the other use side heat exchangers 26 whose operation modes are not changed is suppressed. The control is not limited to this. For example, the opening-degree of the three-way valve 25 connected to the indoor unit 2 (use side heat exchanger 26) whose operation state is changed may be controlled so that the difference between the temperature of the heat medium flowing into this use side heat exchanger 26 and that flowing out thereof is a predetermined temperature difference. Specifically, to suppress a change in air output temperature in each of the other use side heat exchangers 26 whose operation modes are not changed, a target value $t_{o1}$ of the difference between the temperature of the heat medium flowing into the use side heat exchanger 26 whose operation state is changed and that of the heat medium flowing out thereof is set to a value greater than a target value $t_{o2}$ in the normal operation. Consequently, the flow rate of the heat medium flowing out of the use side heat exchanger 26 whose operation state is changed is suppressed, so that a change in air output temperature in each of the other use side heat exchangers 26 whose operation modes are not changed is suppressed.

Incidentally, the temperature, flow rate, or the like of the heat medium described in Embodiments 1 and 2 merely indicates a preferred condition. Even when the temperature, flow rate, or the like of the heat medium changes, the present invention can be embodied.

Further, the flow rate of the heat medium flowing into each of the use side heat exchangers 26*a* to 26*d* can be adjusted on the basis of a detected value other than the detected values used in Embodiments 1 and 2. For example, the flow rate of the heat medium flowing into each of the use side heat exchangers 26*a*, 26*b*, 26*c*, and 26*d* may be adjusted on the basis of temperatures detected by the temperature sensors 32*a* and 32*b* (temperatures of the heat medium flowing into the intermediate heat exchangers 15*a* and 15*b*). Alternatively, for example, the flow rate of the heat medium flowing into each of the use side heat exchangers 26*a*, 26*b*, 26*c*, and 26*d* may be adjusted on the basis of the condensation temperature of the refrigerant flowing through the intermediate heat exchanger 15*a* which is obtained from a pressure detected by the pressure sensor 36 or the evaporation temperature of the refrigerant flowing through the intermediate heat exchanger 15*b* which is detected by the temperature sensor 37. The flow rate of the heat medium flowing into each of the use side heat exchangers 26*a*, 26*b*, 26*c*, and 26*d* may be adjusted on the basis of a plurality of detected values of these detected values. Regarding a sensor which is not used for flow rate adjustment, it is unnecessary to provide such a sensor for the heat medium circulation circuit.

Further, in Embodiments 1 and 2, the three-way valve 25 is provided for a joint between the bypass 27 and the heat medium pipe 5 connecting the use side heat exchanger 26 and the three-way valve 23. The three-way valve 25 may be provided for a joint between the bypass 27 and the heat medium pipe connecting the use side heat exchanger 26 and the three-way valve 22.

In addition, the three-way valve 25 and the bypass 27 constitute the heat medium flow rate adjusting unit in Embodiments 1 and 2. The stop valve 24 may be configured to be capable of adjusting the flow rate and the stop valve 24 may serve as a heat medium flow rate adjusting unit.

Moreover, in the refrigeration cycle circuit which serves as the heat source side in Embodiments 1 and 2, in addition to the refrigerant from which a large heat quantity is obtained using a phase change between gas and liquid, such as hydrofluorocarbon, a refrigerant which may become a supercritical state while being used, e.g., carbon dioxide, can be used. In this case, in the cooling only operation and the cooling-main operation, the heat source side heat exchanger 12 functions as a gas cooler. The intermediate heat exchanger 15*a* also functions as a gas cooler and heats the heat medium. Further, since the refrigerant in the supercritical state is not separated into two phases of gas and liquid, it is unnecessary to dispose the gas-liquid separator 14.

Further, although the heat source of the heat source unit is the refrigeration cycle circuit in Embodiments 1 and 2, various heat sources, such as a heater, can be used.

The invention claimed is:

1. An air-conditioning apparatus comprising:

a heat medium loop;

a refrigerant loop;

a plurality of use side heat exchangers connected to the heat medium loop;

a first heat exchanger that exchanges heat between heat medium and the refrigerant to heat the heat medium;

a second heat exchanger that exchanges heat between the heat medium and the refrigerant to cool the heat medium;

each use side heat exchanger associated with:

a respective heat medium flow path switching device including a valve that switches between a flow path connecting said first heat exchanger to the respective use side heat exchangers and a flow path connecting said second heat exchanger thereto alternatively;

a respective heat medium flow rate adjusting unit including a first valve and a second valve, said heat medium flow rate adjusting unit configured to control the flow rate of the heat medium flowing into the respective use side heat exchanger;

a respective first heat medium temperature sensor that detects a temperature of the heat medium flowing out of the respective use side heat exchanger;

the apparatus further includes a controller configured to control the heat medium flow path switching devices and the heat medium flow rate adjusting units;

the controller configured to perform an operation including the following steps:

first, detect when one of the use-side heat exchangers has 1) switched from an inactive state to an active state or 2) has switched from cooling mode to heating mode, or from heating mode to cooling mode;

second, accordingly control the respective use-side heat exchanger's heat medium flow path switching device;

third, detect whether another use-side heat exchanger is engaged in the same active operation mode as the respective use-side heat exchanger;

if the answer to the third step is NO, then the controller adjusts the respective second valve on the basis of air conditioning load to the respective use-side heat exchanger, if the answer to the third step is YES, then the controller is configured to perform an operation including the following steps:

first, the controller sets the respective first valve to a predetermined opening degree;

second, the controller opens the respective second valve;

third, the controller receives a temperature measurement from the respective first heat medium temperature sensor, if the temperature is less than or equal to a first threshold temperature, then the controller closes the respective first valve by a predetermined amount in order to suppress a temperature change in the heat medium; and fourth, the controller adjusts the respective second valve on the basis of air conditioning load at the respective use-side heat exchanger.

2. The air-conditioning apparatus of claim 1, wherein said heat medium flow rate adjusting unit is provided at the upstream or downstream of each use side heat exchanger and controls flow rate of the heat medium of the use side heat exchanger individually.

3. The air-conditioning apparatus of claim 1, wherein said heat medium flow rate adjusting unit further comprises:

a heat medium bypass pipe, one end thereof being connected to a heat medium inflow side of said use side heat exchangers, the other end thereof being connected to a heat medium outflow side of said use side heat exchangers, a second heat medium temperature sensor that detects a temperature of the heat medium flowing out of said heat medium bypass pipe.

4. The air-conditioning apparatus of claim 1, further comprising:

a second heat medium temperature sensor that detects a temperature of the heat medium flowing into said use side heat exchangers, wherein said controller controls said heat medium flow rate adjusting unit such that the difference between the temperature detected by the second heat medium temperature sensor and the temperature detected by said first heat medium temperature sensor is made to be a predetermined temperature difference.

5. The air-conditioning apparatus of claim 1, wherein when part of said use side heat exchangers is switched from the stop state to the operation state or switched to another operation mode, the controller is further configured to pause a fan sending air to a respective use side heat exchanger for a predetermined time upon detecting that the respective use side heat exchanger has 1) switched from an inactive state to an active state or 2) has switched from cooling mode to heating mode, or from heating mode to cooling mode.

6. The air-conditioning apparatus of claim 5, wherein when a reduction of the flow rate of the heat medium flowing into said use side heat exchanger switched from the stop state to the operation state or switched to the other operation mode is completed, said fan is started even before the lapse of the predetermined time is terminated.

7. The air-conditioning apparatus of claim 1, further comprising a refrigeration cycle circuit including a compressor, a heat source side heat exchanger, at least one expansion device that adjusts a pressure of the refrigerant, said first heat exchanger, and said second heat exchanger, which are connected by piping, wherein by the refrigerant circulating in the refrigeration cycle circuit, the heat medium flowing through said first heat exchanger is heated and the heat medium flowing through said second heat exchanger is cooled.

8. The air-conditioning apparatus of claim 7, wherein the refrigerant circulating in said refrigeration cycle circuit is carbon dioxide.

9. The air-conditioning apparatus of claim 3, wherein said heat medium bypass pipe is arranged between each of said use side heat exchangers and said heat medium flow path switcher corresponding to the use side heat exchanger.

10. A method for controlling an air-conditioning apparatus that includes:

a heat medium loop, a refrigerant loop, a plurality of use side heat exchangers connected to the heat medium loop, a first heat exchanger that exchanges heat between a heat medium and the refrigerant to heat the heat medium, a second heat exchanger that exchanges heat between the heat medium and the refrigerant to cool the heat medium, each use side heat exchanger associated with:

a respective heat medium flow path switching device including a valve that switches between a flow path connecting said first heat exchanger to the respective use side heat exchangers and a flow path connecting said second heat exchanger thereto alternatively, a respective heat medium flow rate adjusting unit including a first valve and a second valve, said heat medium flow rate adjusting unit configured to control the flow rate of the heat medium flowing into the respective use side heat exchanger, a respective first heat medium temperature sensor that detects a temperature of the heat medium flowing out of the respective use side heat exchanger;

the method comprising:

controlling, with a controller, the heat medium flow path switching devices and the heat medium flow rate adjusting units; and performing, with the controller, an operation including the following steps:

first, detecting when one of the use-side heat exchangers has 1) switched from an inactive state to an active state or 2) has switched from cooling mode to heating mode, or from heating mode to cooling mode;

second, accordingly controlling the respective use-side heat exchanger's heat medium flow path switching device;

third, detecting whether another use-side heat exchanger is engaged in the same active operation mode as the respective use-side heat exchanger;

if the answer to the third step is NO, adjusting, by the controller, the respective second valve on the basis of air conditioning load to the respective use-side heat exchanger, and if the answer to the third step is YES, performing an operation including the following steps:

first, setting the respective first valve to a predetermined opening degree;

second, opening the respective second valve;

third, receiving a temperature measurement from the respective first heat medium temperature sensor, if the temperature is less than or equal to a first threshold temperature, then closing the respective first valve by a predetermined amount in order to suppress a temperature change in the heat medium; and fourth, adjusting the respective second valve on the basis of air conditioning load at the respective use-side heat exchanger.

* * * * *